US008256371B2

(12) United States Patent
Takatsuka

(10) Patent No.: US 8,256,371 B2
(45) Date of Patent: Sep. 4, 2012

(54) APPLICATION LIQUID SUPPLY APPARATUS AND INKJET RECORDING APPARATUS

(75) Inventor: Tsutomu Takatsuka, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 444 days.

(21) Appl. No.: 12/406,673

(22) Filed: Mar. 18, 2009

(65) Prior Publication Data

US 2009/0235863 A1 Sep. 24, 2009

(30) Foreign Application Priority Data

Mar. 19, 2008 (JP) ..... 2008-071169

(51) Int. Cl.
*B05C 1/00* (2006.01)
*B05D 1/28* (2006.01)

(52) U.S. Cl. ..... 118/200; 427/428.01

(58) Field of Classification Search ..... None
See application file for complete search history.

(56) References Cited

U.S. PATENT DOCUMENTS

| | | | | |
|---|---|---|---|---|
| 2,018,193 | A * | 10/1935 | Smith | 101/366 |
| 4,009,657 | A * | 3/1977 | Bonanno et al. | 101/157 |
| 5,086,701 | A * | 2/1992 | Gasparrini et al. | 101/425 |
| 5,628,827 | A * | 5/1997 | McCollam et al. | 118/695 |
| 5,638,751 | A * | 6/1997 | Daetwyler et al. | 101/169 |
| 6,379,463 | B1 * | 4/2002 | Kelley et al. | 118/666 |
| 2008/0236423 | A1 * | 10/2008 | Baumann et al. | 101/425 |

FOREIGN PATENT DOCUMENTS

JP 2007-117806 A 5/2007

* cited by examiner

*Primary Examiner* — Dah-Wei Yuan
*Assistant Examiner* — Charles Capozzi
(74) *Attorney, Agent, or Firm* — Birch, Stewart, Kolasch & Birch, LLP

(57) ABSTRACT

An application liquid supply apparatus supplying an application liquid to an application roller, includes: a space forming member which is abutted against an outer circumferential surface of the application roller and of which a recess section is formed along a breadthways direction of the application roller in a surface which abuts against the application roller, and a frame-shaped abutting section is provided in a projecting fashion so as to surround a perimeter of the recess section, the abutting section being abutted against the outer circumferential surface of the application roller so as to cover an opening of the recess section with the outer circumferential surface of the application roller in such a manner that an application liquid holding space is created along the breadthways direction on the outer circumferential surface of the application roller; at least one groove which has a length in a direction of rotation of the application roller and is formed in the abutting section on an upstream side in terms of the direction of the rotation of the application roller; an application liquid supply port which is formed in the space forming member and via which the application liquid is supplied to the application liquid holding space; and an application liquid supply device which supplies the application liquid to the application liquid holding space via the application liquid supply port.

10 Claims, 13 Drawing Sheets

APPLICATION LIQUID SUPPLY APPARATUS AND INKJET RECORDING APPARATUS

BACKGROUND OF THE INVENTION

1. Field of the Invention

The present invention relates to an application liquid supply apparatus and an inkjet recording apparatus, and more particularly, to an application liquid supply apparatus and an inkjet recording apparatus which supply an application liquid to an application roller.

2. Description of the Related Art

In an inkjet recording apparatus which forms an image by ejecting ink droplets, if a color image is formed by using inks of a plurality of colors, then there is a possibility that color bleeding occurs. Furthermore, if an image is formed on a recording medium of high permeability, such as normal paper, then there is a possibility that the feathering phenomenon occurs.

Color bleeding or feathering of this kind reduces the quality of the image and therefore preventative measures of various kinds have been proposed. As one such measure, a method is known in which a treatment liquid that aggregates or insolubilizes the coloring material in an ink by reacting with the ink is applied previously to a recording medium, and an image is formed by ejecting ink droplets onto the recording medium to which this treatment liquid has been applied. In this method, the application of the treatment liquid is performed using an application roller or an inkjet head, the treatment liquid being applied to the recording medium by bringing an application roller having treatment liquid deposited on the circumference thereof into contact with the recording medium, or by ejecting treatment liquid onto the recording medium from an inkjet head.

Japanese Patent Application Publication No. 2007-117806 discloses a mechanism for supplying treatment liquid to an application roller, in which an application liquid holding member is placed in contact with the outer circumferential surface of an application roller, treatment liquid is supplied to a space formed on the outer circumferential surface of the application roller (an application liquid holding space) by this application liquid holding member, and the treatment liquid is thereby supplied to the application roller. By means of this mechanism, due to rotation of the application roller, the outer circumferential surface of the roller makes contact with the treatment liquid held in the application liquid holding space, thus supplying treatment liquid to the outer circumferential surface.

If treatment liquid is applied to a recording medium by means of an application roller, then generally the application roller waits at standby in a position separated from the conveyance surface of the recording medium, and is then pressed to make contact with the recording medium in synchronism with the conveyance timing of the recording medium.

However, in Japanese Patent Application Publication No. 2007-117806, since the application roller is not rotated during standby, then the supply of treatment liquid to the application roller is not stable and consequently, there is a possibility that non-uniformities occur in the treatment liquid which has been applied to the recording medium.

On the other hand, if the application roller is rotated during standby, then the treatment liquid supplied from the application liquid holding member is returned directly to the application liquid holding member, and therefore collection of liquid occurs in the region where the liquid returns to the application liquid holding member and this liquid spills over and soils the apparatus. More specifically, since an application liquid holding member is provided in close contact with the outer circumferential surface of the application roller, then if treatment liquid is left on the application roller, this liquid is wiped away by the edge portion of the application liquid holding member when it returns to the application liquid holding member and spills over the rim of same, thus soiling the apparatus.

SUMMARY OF THE INVENTION

The present invention has been contrived in view of the foregoing circumstances, an object thereof being to provide an application liquid supply apparatus and inkjet recording apparatus whereby application liquid can be supplied stably without causing soiling of the apparatuses.

In order to attain an object described above, one aspect of the present invention is directed to an application liquid supply apparatus supplying an application liquid to an application roller which abuts against a medium while rotating so as to apply the application liquid to the medium, the application liquid supply apparatus comprising: a space forming member which is abutted against an outer circumferential surface of the application roller and of which a recess section is formed along a breadthways direction of the application roller in a surface which abuts against the application roller, and a frame-shaped abutting section is provided in a projecting fashion so as to surround a perimeter of the recess section, the abutting section being abutted against the outer circumferential surface of the application roller so as to cover an opening of the recess section with the outer circumferential surface of the application roller in such a manner that an application liquid holding space is created along the breadthways direction on the outer circumferential surface of the application roller; at least one groove which has a length in a direction of rotation of the application roller and is formed in the abutting section on an upstream side in terms of the direction of the rotation of the application roller; an application liquid supply port which is formed in the space forming member and via which the application liquid is supplied to the application liquid holding space; and an application liquid supply device which supplies the application liquid to the application liquid holding space via the application liquid supply port.

According to this aspect of the invention, by abutting the space forming member against the outer circumferential surface of the application roller, the application liquid holding space is formed through the breadthways direction on the outer circumferential surface of the application roller, and by supplying application liquid to this application liquid holding space from the application liquid supply port, the application liquid is supplied to the outer circumferential surface of the application roller. In other words, when the application liquid is supplied to the application liquid holding space formed by the space forming member, the application liquid thus supplied is held inside the application liquid holding space in a state of contact with the outer circumferential surface of the application roller. Consequently, when the application roller is turned in this state, then the outer circumferential surface of the application roller makes continuous contact with the application liquid and the application liquid is supplied continuously to the outer circumferential surface of the application roller.

On the other hand, since the at least one groove is formed following the direction of rotation of the application roller in the abutting section of the space forming member, in the upstream side portion thereof in terms of the direction of rotation of the application roller, then even if the application roller is rotated without making contact with a medium, it is possible to recover the application liquid returned to the space forming member via the at least one groove and hence soiling of the apparatus is prevented. In other words, even if there is liquid left on the application roller, this liquid can be recovered into the application liquid holding space via the at least one groove, and therefore it is possible to supply the application liquid continuously in a clean state at all times, without the occurrence of a collection of the application liquid in the portion where the liquid is returned to the space forming member. One groove or a plurality of grooves of this kind may be provide in the abutting section, but from the viewpoint of the efficient recovery of the application liquid, a plurality of grooves are desirably provided in the abutting section.

Furthermore, since the apparatus is not soiled in this way even if the application roller is rotated without making contact with the medium, then it is possible to wait at standby in a state where the application roller has been rotated before application to the medium, and therefore stable application which is free of application non-uniformities can be achieved.

Desirably, the application liquid supply apparatus comprises a pair of squeegees which is provided to a downstream side of the space forming member in terms of the direction of the rotation of the application roller, and which wipes away both end portions of the application liquid that has been supplied to the application roller in such a manner that the application liquid supplied to the outer circumferential surface of the application roller becomes a certain width.

According to this aspect of the invention, the application liquid supplied to the outer circumferential surface of the application roller by passing the application holding space is wiped away at either end portion thereof by passing the pair of squeegees, and is thereby adjusted to a certain width. Consequently, it is possible to supply the application liquid to the application roller at a desired supply width. Furthermore, in this way, it is possible to apply an application liquid to a desired application width on the medium.

Desirably, the squeegees are provided movably in the breadthways direction of the application roller.

According to this aspect of the invention, the pair of squeegees is provided movably along the breadthways direction of the application roller. Thereby, it is possible to adjust the supply width of the application liquid onto the application roller, to any desired width. Furthermore, in this way, it is possible to apply the application liquid to a desired application width on the medium.

Desirably, an application liquid recovery port which recovers the application liquid that has been supplied into the application liquid holding surface is provided in the space forming member; and the application liquid supply device supplies the application liquid to the application liquid holding space in a circular manner via the application liquid supply port and the application liquid recovery port.

According to this aspect of the invention, an application liquid is circulated and supplied to the application liquid holding space. In this way, it is possible to supply the application liquid to the application liquid holding space in a stable fashion.

Desirably, the application liquid supply port is provided to an upstream side of the application liquid recovery port in terms of the direction of the rotation of the application roller.

According to this aspect of the invention, the application liquid supply port is provided to the upstream side of the application liquid recovery port in terms of the direction of rotation of the application roller. In this way, a flow in the direction of rotation of the application roller is created inside the application liquid holding space and therefore the application liquid can be supplied in a stable fashion.

Desirably, the application liquid supply device is able to adjust a circulation volume of the application liquid which is supplied to the application liquid holding space in the circular manner.

According to this aspect of the invention, it is possible to adjust the circulation volume of the application liquid which is circulated and supplied. In this way, it is possible to adjust the thickness (film thickness) of the application liquid that is supplied to the application roller and hence the thickness of the film of application liquid applied to the medium can be adjusted.

Desirably, the application liquid supply device is able to adjust a circulation pressure of the application liquid which is supplied to the application liquid holding space in the circular manner.

According to this aspect of the invention, it is possible to adjust the circulation pressure of the application liquid which is circulated and supplied. In this way, it is possible to adjust the film thickness of the application liquid that is supplied to the application roller and hence the thickness of the film of application liquid applied to the medium can be adjusted.

In order to attain an object described above, another aspect of the present invention is directed to an inkjet recording apparatus ejecting an ink onto a medium, comprising one of the above-described application liquid supply apparatuses, wherein: the application liquid has a function of reacting with the ink so as to aggregate or insolubilize a coloring material contained in the ink; the application liquid supply apparatus supplies the application liquid to the application roller; the application roller applies the application liquid to the medium; and the ink is ejected onto the medium on which the application liquid has been applied in such a manner that an image is formed on the medium.

According to this aspect of the invention, it is possible to apply an application liquid in a stable fashion without causing soiling of the apparatus, in an inkjet recording apparatus which forms an image by applying to a medium an application liquid having a function of aggregating or insolubilizing a coloring material by reacting with ink.

According to the present invention, it is possible to supply application liquid in a stable fashion, without causing soiling of the apparatus.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
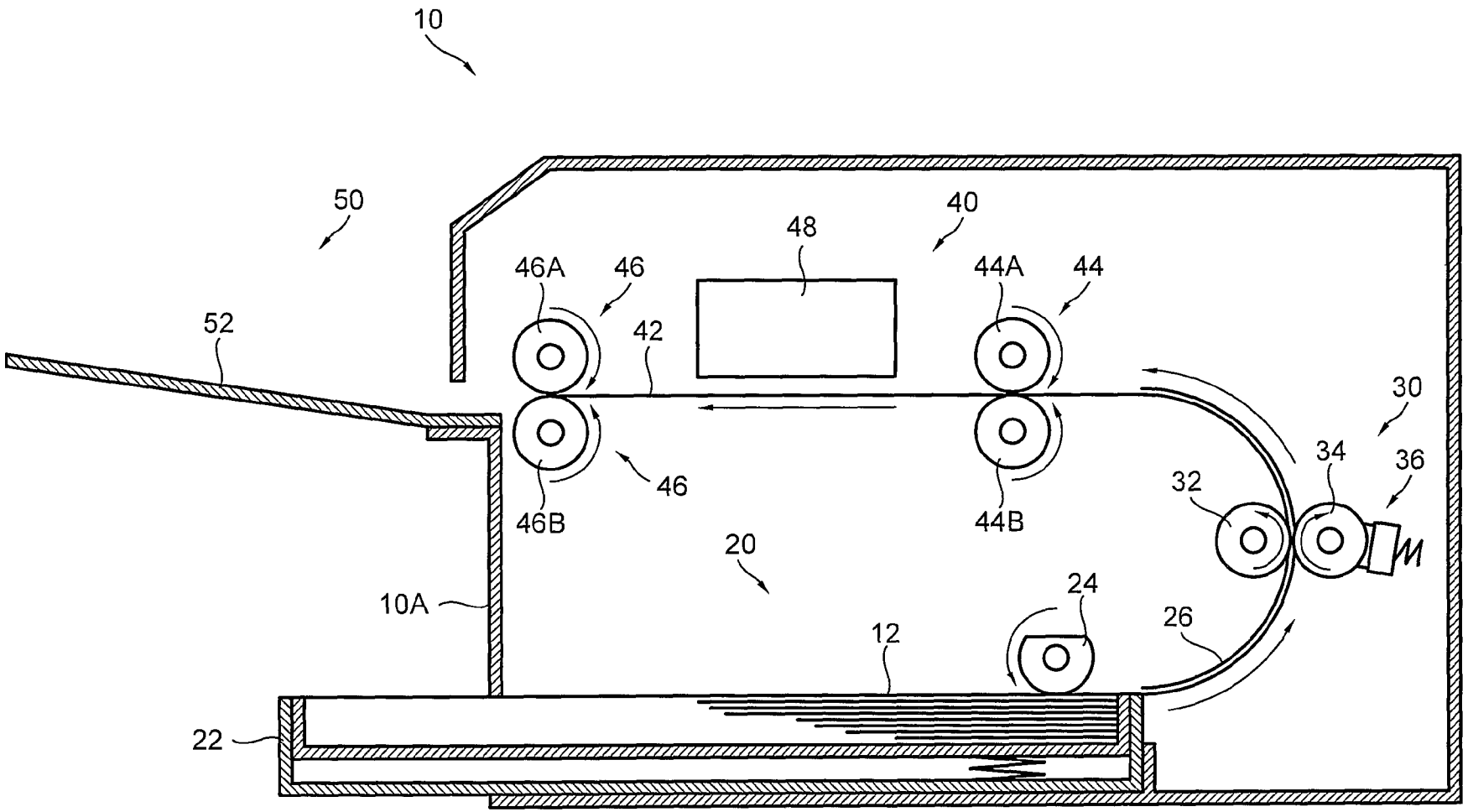
FIG. 1 is a cross-sectional side view diagram illustrating the approximate composition of one example of an inkjet recording apparatus to which an embodiment of the present invention is applied.

FIG. 1 is a cross-sectional side diagram illustrating the approximate composition of an inkjet recording apparatus to which an embodiment of the present invention is applied.

As illustrated in FIG. 1, the inkjet recording apparatus 10 according to the present embodiment is an inkjet recording apparatus which forms an image by ejecting ink droplets onto paper (cut paper) which has been cut to a prescribed size, and comprises: a paper supply unit 20 which supplies paper 12; a treatment liquid application unit (application apparatus) 30 which applies liquid (treatment liquid) having a function of aggregating the coloring material of the ink onto the paper 12 which is supplied from the paper supply unit 20; an image forming unit 40 which forms an image by ejecting ink droplets onto the paper 12 onto which the treatment liquid has been applied; and a paper output unit 50 which outputs the paper 12 on which the image has been formed.

The paper supply unit 20 comprises a paper supply cassette 22 in which the paper 12 is loaded and a paper supply roller 24 which supplies paper 12 that has been loaded in the paper supply cassette 22.

The paper supply cassette 22 is provided detachably on the main body 10A of the inkjet recording apparatus 10. The paper 12 is loaded in a stacked state in the paper supply cassette 22.

The paper supply roller 24 is disposed above the paper supply cassette 22 which is located in a prescribed position. This paper supply roller 24 has a half moon-like shape and rotates by means of being driven by a motor (not illustrated).

Due to the rotation of the paper supply roller 24, the paper 12 which is loaded in the paper supply cassette 22 is supplied in sequence from the top, one sheet at a time, toward a prescribed conveyance path.

The paper 12 which has been supplied from the paper supply unit 20 travels along a conveyance path 26 formed in a circular arc shape, and treatment liquid is applied thereto by the treatment liquid application unit 30 which is provided in the conveyance path 26.

The treatment liquid application unit 30 applies, onto the surface (image forming surface) of the paper 12, a treatment liquid (application liquid) having a function of aggregating a coloring material of an ink by reacting with ink. This treatment liquid application unit 30 comprises a back-up roller 32, an application roller 34, and a treatment liquid supply unit 36.

The back-up roller 32 and the application roller 34 are disposed so as to be mutually opposing on either side of the conveyance path 26. The paper 12 is conveyed while being sandwiched between the back-up roller 32 and the application roller 34, and the treatment liquid supplied to the surface (outer circumferential surface) of the application roller 34 during this conveyance stage is transferred and applied to the image forming surface.

The back-up roller 32 is formed to have a width equal to or greater than the width of the paper 12 (the length thereof in the axial direction), and either end portion thereof is supported rotatably via a bearing on a frame (not illustrated). The frame which supports the back-up roller 32 is provided in an advanceable and retractable fashion at a prescribed stroke with respect to the application roller 34, and is impelled toward the application roller 34 by means of an impelling device (for example, a spring, or the like) which is not illustrated.

Furthermore, the back-up roller 32 has a lyophobic treatment provided on the surface (outer circumferential surface) thereof (for example, a coating of Teflon (registered trademark), or the like), thereby achieving a composition which makes treatment liquid not liable to adhere to the roller.

The application roller 34 is formed at approximately the same width as the back-up roller 32 (the length in the axial direction), and the respective both end portions thereof are supported rotatably via bearings on a frame (not illustrated).

The frame which supports the application roller 34 is provided in an advanceable and retractable fashion with respect to the back-up roller 32, and is moved between a prescribed abutting position and a standby position by being driven by an actuator (for example, a cylinder), which is not illustrated. When the frame is moved to the abutting position, it abuts and presses against the surface of the back-up roller 32 and when it is moved to the standby position, it is withdrawn with respect to the back-up roller 32.

Furthermore, a motor (not illustrated) is installed in the frame which supports the application roller 34 and the application roller 34 is driven and caused to rotate (in the present embodiment, rotate in the clockwise rotation direction) by the motor. The paper 12 is conveyed along c by the rotation of the application roller 34.

The treatment liquid supply unit 36 supplies the treatment liquid at a prescribed thickness (film thickness) to the surface (outer circumferential surface) of the application roller 34. The concrete structure of this treatment liquid supply unit 36 is described later.

When the recording paper 12 conveyed along the conveyance path 26 passes between the back-up roller 32 and the application roller 34, the application roller 34 abuts against the surface (image forming surface) of the recording paper 12 and the treatment liquid is thereby applied onto the surface.

The paper 12 to which the treatment liquid has been applied is conveyed to the image forming unit 40, and ink droplets are ejected onto and an image is thereby formed on the surface of the paper. This image forming unit 40 includes a platen 42, a first conveyance roller pair 44, a second conveyance roller pair 46 and an ink ejection unit 48.

The platen 42 is disposed horizontally. Paper 12 which has been conveyed through the circular arc-shaped conveyance path 26 is mounted on the platen 42.

The first conveyance roller pair 44 and the second conveyance roller pair 46 convey the paper 12 which has been mounted on the platen 42.

This first conveyance roller pair 44 is constituted by a drive roller 44A and an idle roller 44B, and is disposed to the upstream side of the platen 42 in terms of the conveyance direction. The drive roller 44A and the idle roller 44B included in the first conveyance roller pair 44 are disposed in opposing upper and lower positions on either side of the platen 42 and the respective end portions thereof are supported rotatably on bearings (not illustrated) which are provided on the main body 10A of the apparatus. A motor (not illustrated) is coupled to the drive roller 44A and this drive roller 44A is driven so as to rotate by this motor.

The paper 12 which has been conveyed along the circular arc shaped conveyance path 26 is mounted on the platen 42 and is supplied between the drive roller 44A and the idle roller 44B of the first conveyance roller pair 44. The paper is gripped between the drive roller 44A and the idle roller 44B of the first conveyance roller pair 44 and is conveyed on the platen 42.

The second conveyance roller pair 46 is constituted by a drive roller 46A and an idle roller 46B, and is disposed to the downstream side of the platen 42 in terms of the direction of conveyance. The drive roller 46A and the idle roller 46B included in the second conveyance roller pair 46 are disposed in opposing upper and lower positions on either side of the platen 42 and the respective end portions thereof are supported rotatably on bearings (not illustrated) which are provided on the main body 10A of the apparatus. The drive roller 46A is coupled to a motor (not illustrated) and is driven so as to rotate by the motor.

Paper 12 which has been conveyed over the platen 42 is supplied between the drive roller 46A and the idle roller 46B of the second conveyance roller pair 46. The paper is gripped between the drive roller 46A and the idle roller 46B of the second conveyance roller pair 46 and is conveyed toward the paper output unit 50 which is on the downstream side.

The ink ejection unit 48 ejects ink droplets of the four colors of cyan (C), magenta (M), yellow (Y) and black (K) onto the paper 12 which is conveyed over the platen 42, thereby forming a color image on the surface of the paper 12.

This ink ejection unit 48 comprises independent inkjet heads (not illustrated) for respective colors and the ink droplets of the respective colors are ejected independently and respectively from the corresponding inkjet heads. In other words, cyan ink droplets are ejected from a cyan inkjet head, magenta ink droplets are ejected from a magenta inkjet head, yellow ink droplets are ejected from a yellow inkjet head and black ink droplets are ejected from a black inkjet head, respectively and independently.

Here, the inkjet heads of the respective colors are each respectively constituted by full line type inkjet heads which form an image on the surface of paper 12 by ejecting ink droplets from a nozzle row (a row of nozzles (ink ejection ports) that eject ink droplets) formed on the ink ejection surface (the surface form which ink is ejected) of the head. This nozzle row is formed to a width corresponding to the paper 12. In other words, it is formed to a length which is able to cover the full width of the image forming region (the region where ink droplets are deposited and an image is formed) set on the paper 12.

Furthermore, the respective inkjet heads have respective nozzle rows disposed so as to intersect with the direction of the conveyance of the paper 12 (sub-scanning direction), and the ink ejection surfaces thereof are disposed so as to maintain a prescribed clearance with respect to the platen 42.

Moreover, the inkjet heads are disposed in a prescribed color sequence at a prescribed interval apart in sequence from the upstream side in terms of the direction of conveyance of the paper 12. For example, the inkjet heads of the respective colors are disposed in the sequence cyan (C), magenta (M), yellow (Y) and black (K) from the upstream side in terms of the direction of conveyance of the paper 12.

When the paper 12 which is being conveyed over the platen 42 passes below the ink ejection unit 48, ink droplets are ejected from the respective inkjet heads and an image is formed on the surface of the paper 12.

Here, since treatment liquid has previously been applied to the surface of the paper 12, then when the ink droplets land on the surface of the paper 12, the coloring material in these ink droplets aggregates due to the action of the treatment liquid. Consequently, it is possible effectively to prevent the occurrence of bleeding, and the like. In other words, when an ink droplet lands on the layer of aggregating treatment agent, the ink droplet lands with a prescribed contact surface area on the layer of aggregating treatment agent, based on a balance between the kinetic energy (flight energy) and the surface energy of the droplet. Such an aggregating reaction starts immediately after the ink droplet has landed on the aggregating treatment agent, but this reaction starts from the contact surface between the ink droplet and the aggregating treatment agent layer. The aggregating reaction occurs only in the vicinity of the contact surface, and the coloring material in the ink aggregates while the contact surface area is kept and the ink droplet (coloring material) receives an adhesive force in the contact surface area upon landing of the ink; therefore, movement of the coloring material is suppressed. Therefore, even if another ink droplet is deposited adjacently to this ink droplet, since the coloring material of the previously deposited ink has already aggregated, then the coloring material does not mix with the subsequently deposited ink, and therefore bleeding is suppressed.

In the present example, a full line type of inkjet head is employed, but it is also possible to use a so-called serial type (shuttle type) of inkjet head (an inkjet head of a type which moves back and forth reciprocally in the main scanning direction).

Furthermore, in the present embodiment, an image is formed by inks of four colors of cyan (C), magenta (M), yellow (Y) and black (K), but the number and combination of the colors of inks used are not limited to these. It is also possible to use light inks, dark inks, special color inks, or the like, in a complementary fashion, according to requirements. For example, it is possible to adopt a composition which additionally comprises inkjet heads for ejecting light inks, such as light cyan, light magenta, and the like. Furthermore, there are no particular restrictions of the sequence in which the inkjet heads of respective colors are arranged.

For the ink liquids, a liquid containing pigment as a coloring material, a resin polymer, a dispersant and a surfactant, and the like, is used.

The paper output unit 50 comprises a paper output tray 52. The paper 12 on which an image has been formed by means of ink droplets being ejected onto the surface thereof by the image forming unit 40 is conveyed to the second conveyance roller pair 46 of the image forming unit 40 and is output to the paper output tray 52.

Figure 2:
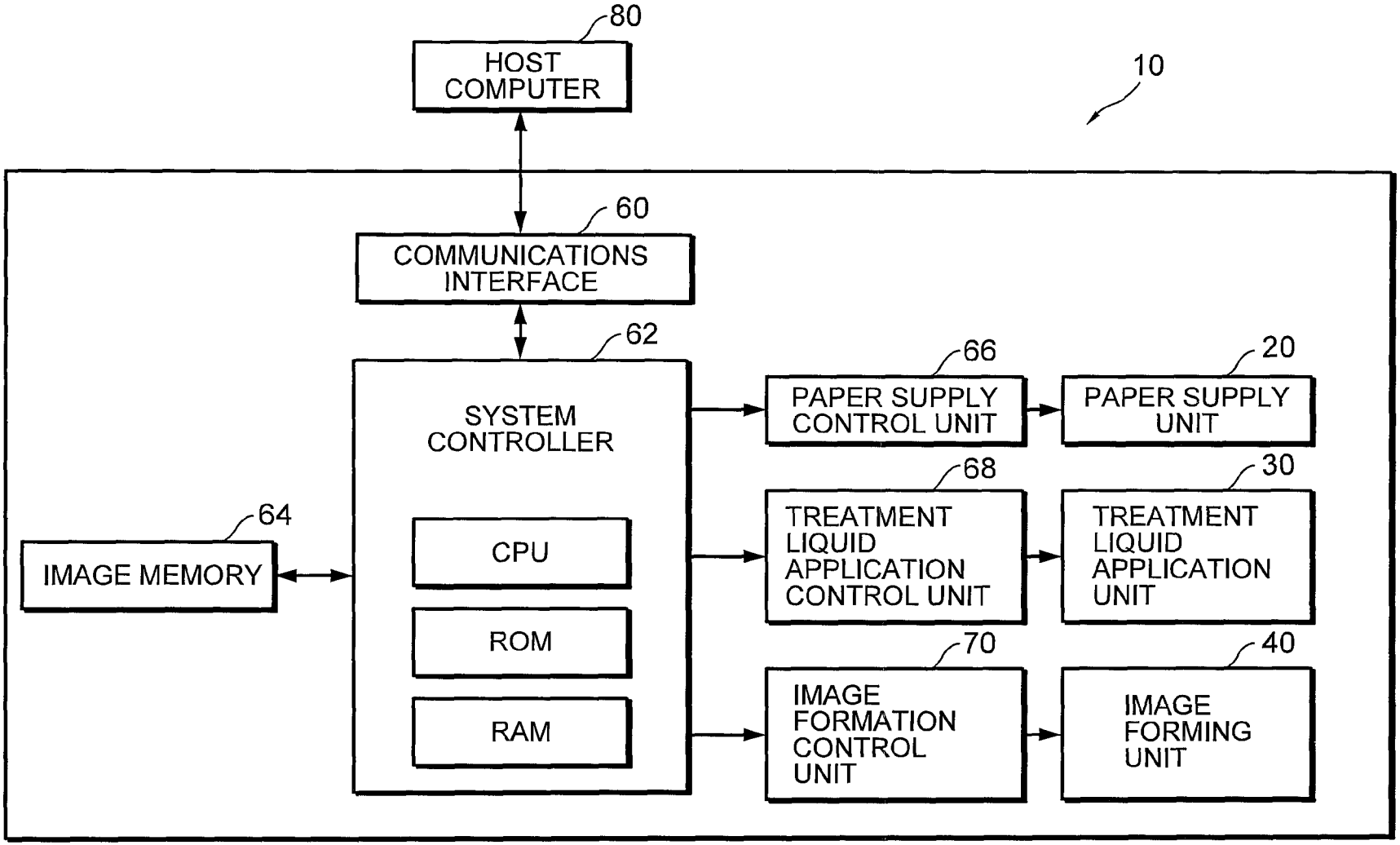
FIG. 2 is a block diagram illustrating the system composition of the control system of an inkjet recording apparatus.

FIG. 2 is a block diagram illustrating the approximate composition of a control system in an inkjet recording apparatus according to the present embodiment.

As illustrated in FIG. 2, the inkjet recording apparatus 10 comprises a communications interface 60, a system controller 62, an image memory 64, a paper supply control unit 66, a treatment liquid application control unit 68, an image formation control unit 70, and the like.

The communications interface 60 is an interface unit for receiving image data which is transmitted by a host computer 100. Image data sent by the host computer 100 is read in to the inkjet recording apparatus 10 via this communications interface 60.

The image memory 64 is a storage device which temporarily stores an image input via the communications interface 60, and data is read from and written to the image memory 64 via the system controller 62.

The system controller 62 is a control unit which controls each of units of the inkjet recording apparatus 10 and comprises a CPU, ROM, RAM, and the like. This system controller 62 controls respective sections of the inkjet recording apparatus 10 in accordance with prescribed control programs. The control programs, which are executed by the system controller 62, are stored in the ROM.

The paper supply control unit 66 controls the driving of the paper supply unit 20 in accordance with instructions from the system controller 62.

The treatment liquid application control unit 68 controls the driving of the treatment liquid application unit 30 in accordance with instructions from the system controller 62.

The image formation control unit 70 controls the driving of the image forming unit 40 in accordance with instructions from the system controller 62.

The image forming processing by the inkjet recording apparatus 10 according to the present embodiment which has the composition described above is as follows.

The paper supply cassette 22 in which the paper 12 has been loaded is set in the main body 10A of the apparatus and when the paper supply roller 24 turns, the sheet of paper 12 situated in the uppermost position of the paper supply cassette 22 is supplied toward the conveyance path 26.

The paper 12 which has been supplied from the paper supply cassette 22 travels along the conveyance path 26 in the shape of a circular arc, and the paper 12 passes through the treatment liquid application unit 30 in the conveyance process so that the treatment liquid is applied to the surface (image forming surface) of the paper 12. In other words, when the paper travels through the treatment liquid application unit 30, the application roller to which the treatment liquid has been supplied abuts against the paper 12 and the treatment liquid is thereby applied to the surface of the paper 12.

The paper 12 onto which the treatment liquid has been applied is output from the conveyance path 26 onto the platen 42. The paper 12 which has been output onto the platen 42 is thus caused to travel over the platen 42 by the first conveyance roller pair 44, and ink droplets are ejected from the ink ejection unit 44 during this conveyance process, thereby forming an image on the surface of the paper 12.

The paper 12 on the surface of which an image has been formed is conveyed by the second conveyance roller pair 46 and is output onto the paper output tray 52.

As described above, in the inkjet recording apparatus 10 according to the present embodiment, the treatment liquid (application liquid), which reacts with the ink to aggregate or insolubilize the coloring material of the ink, is previously applied onto the paper 12 in the treatment liquid application unit 30, and then ink droplets deposited onto the paper 12 on which the treatment liquid has been applied so as to form an image. In this way, defects such as color breeding are effectively prevented and high quality images can be formed.

Figure 3:
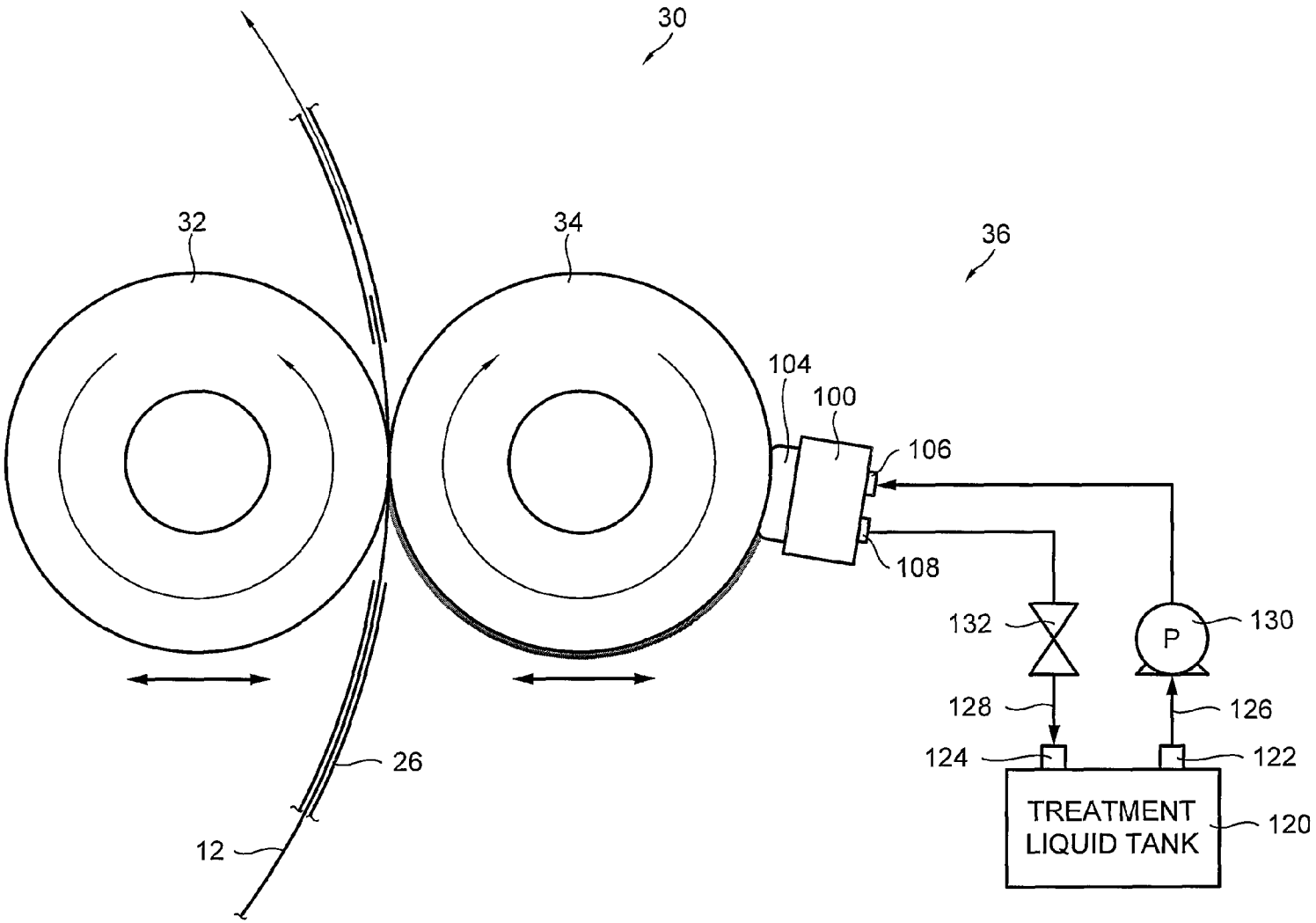
FIG. 3 is a side view diagram of a treatment liquid application unit.

FIG. 3 illustrates a lateral view indicating the structure of the treatment liquid application unit. As described above, the treatment liquid application unit 30 includes the back-up roller 32, the application roller 34, and the treatment liquid supply unit 36 supplying the treatment liquid to the application roller 34.

The treatment liquid supply unit 36 comprises a space forming block 100, a treatment liquid tank 120 and a pump 130. The space forming block 100 is brought into contact with the outer circumferential surface of the application roller 34 in such a manner that a treatment liquid holding space S is formed on the outer circumferential surface in terms of the breadthways direction. The treatment liquid tank 120 stores the treatment liquid to be supplied to the treatment liquid holding space S formed by the space forming block 100. The pump 130 circularly supplies the treatment liquid stored in the treatment liquid tank 120 to the treatment liquid holding space S.

FIG. 4 to FIG. 8 respectively illustrate a side face cross-sectional view, a side view, a front view, a plan view and a cross-sectional plan view of the composition of the space forming block 100.

As illustrated in FIG. 4 to FIG. 8, the space forming block 100 is formed in a rectangular solid shape having substantially the same width (length in the lengthwise direction) as the width (length in the axial direction) of the application roller 34, and is provided in parallel with the axis of the application roller 34. A rectangular recess section 102 is formed on the front surface of the space forming block 100 (the surface which abuts against the application roller 34). A frame-shaped abutting section 104 is formed so as to project by a prescribed amount, in such a manner that it surrounds the perimeter of the recess section 102.

The recess section 102 is formed so as to span the breadthways direction of the application roller 34 (the lengthwise direction is formed in parallel with the axle of the application roller 34), and is formed to have a prescribed depth from the front end surface of the space forming block 100. Furthermore, the corner portions of the four edges and the bottom face are formed with a circular arc shape.

An abutting section 104 is provided surrounding the perimeter edge of the recess section 102 and is formed so as to project by a prescribed amount from the front end surface of the space forming block 100. This abutting section 104 is formed so as to follow the outer circumferential surface of the application roller 34 in such a manner that it makes close contact with the outer circumferential surface of the application roller 34. In other words, the surfaces which form the front ends of the abutting section 104 are formed so as to correspond to the shape of the circumferential surface of the application roller 34, and have the same curvature as the outer circumferential surface of the application roller 34. Consequently, when the space forming block 100 is abutted against the outer circumferential surface of the application roller 34, it can be abutted without creating a gap against the outer circumferential surface of the application roller 34 (apart from the portions of the grooves which are described hereinafter).

Moreover, front ends of the abutting section 104 are formed to have a circular arc-shaped cross-section. In this way, when the space forming block 100 is abutted against the outer circumferential surface of the application roller 34, it makes contact in a line with the outer circumferential surface of the application roller 34 and the friction received during the rotation of the application roller 34 is reduced.

Furthermore, this abutting section 104 is formed in an integrated fashion with the space forming block 100. In this way, it is possible to prevent damage caused by friction received when the application roller 34 is rotated. The space forming block 100 may be made from resin in an integrated fashion to include this abutting section 104, for example.

The liquid holding space S is formed by abutting the abutting section 104 of the space forming block 100 against the outer circumferential surface of the application roller 34. In other words, when the abutting section 104 of the space forming block 100 is abutted against the outer circumferential surface of the application roller 34, the opening of the recess section 102 formed in the front surface of this space forming block 100 is covered by the outer circumferential surface of the application roller 34, thereby forming a sealed treatment liquid holding space S on the outer circumferential surface of the application roller 34. This treatment liquid holding space S is formed covering the breadthways direction of the application roller 34, and is formed so as to border virtually the whole region thereof in the breadthways direction, except for the respective ends. As described hereinafter, the treatment liquid is supplied to the application roller 34 at a width corresponding to the width of the treatment liquid holding space S (which is equal to the width of the abutting section 104).

A supply port for treatment liquid (treatment liquid supply port) 106 and a recovery port (treatment liquid recovery port) 108 are formed in the rear surface of the space forming block 100 (the surface on the side opposite to the surface where the abutting section 104 is formed). The treatment liquid is supplied into the recess section 102 (the treatment liquid holding space S) from the treatment liquid supply port 106. Furthermore, the treatment liquid supplied to the recess section 102 is circulated and thereby recovered via the treatment liquid recovery port 108.

The treatment liquid supply port 106 and the treatment liquid recovery port 108 are both formed in the center of the breadthways direction of the space forming block 100 (the center of the recess section 102 in terms of the breadthways direction), and the treatment liquid supply port 106 is provided to the upstream side in terms of the direction of rotation of the application roller 34. In the present example, the application roller 34 rotates in the clockwise direction and the space forming block 100 is abutted against the application roller 34 at a diagonally downward right-hand position (approximately a "four o'clock" position) of the application roller 34, and therefore the treatment liquid supply port 106 is formed on the upper side (upstream side) and the treatment liquid recovery port 108 is formed on the lower side (downstream side).

Figure 8:
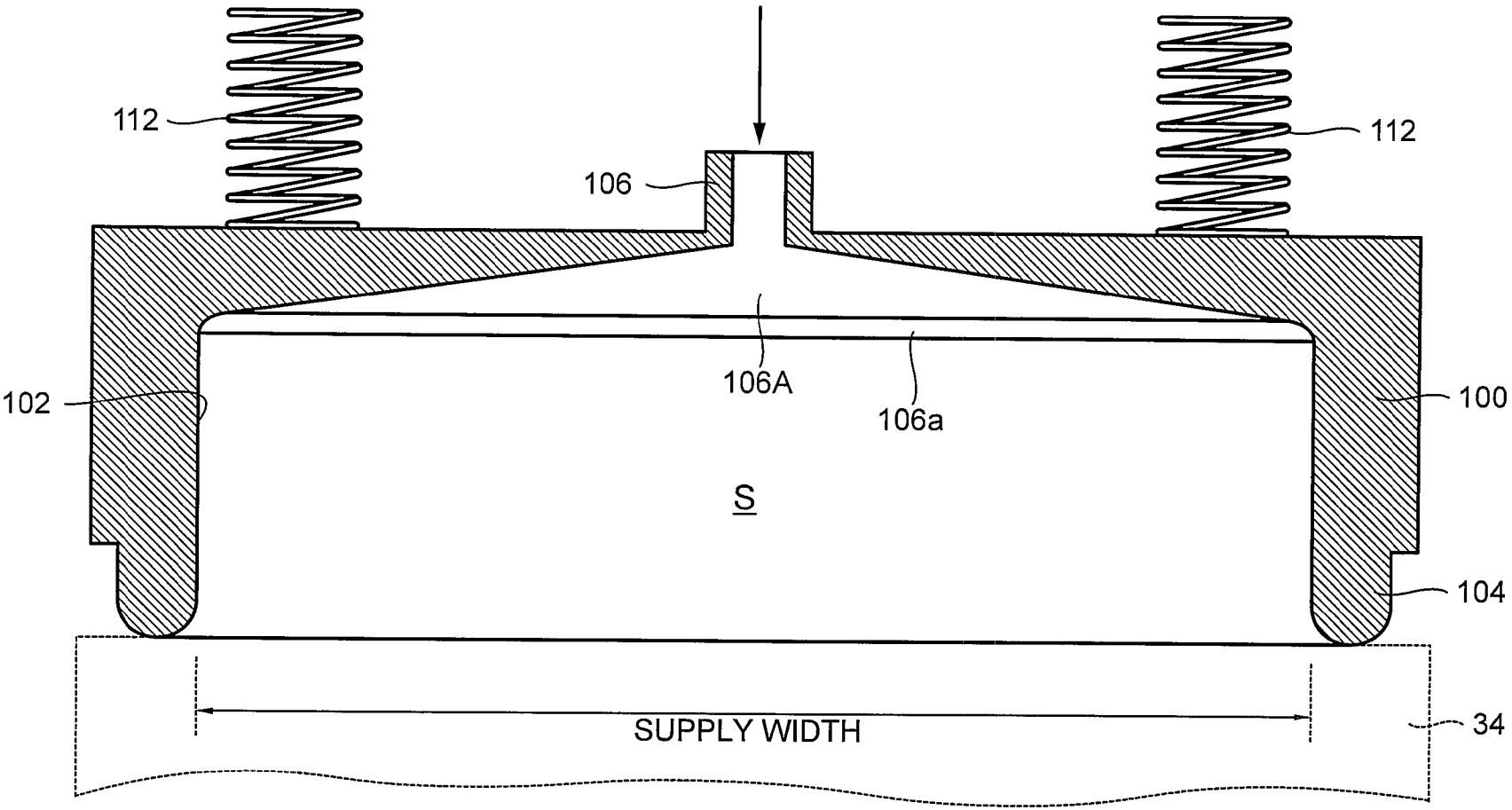
FIG. 8 is a cross-sectional plan view diagram illustrating the composition of the space forming block.

As illustrated in FIG. 8, the treatment liquid supply port 106 which is formed in the space forming block 100 in this way has a flow channel 106A that broadens toward the end inside the space forming block 100. In other words, the front end of the flow channel 106A is formed in a trapezoid shape (or triangular shape), in such a manner that the treatment liquid is supplied to the whole of the breadthways range of the recess section 102. In this way, it is possible to supply the treatment liquid which is supplied from one central point, fully and evenly, in the breadthways direction.

In a similar fashion, the flow channel 108A of the treatment liquid recovery port 108 is formed to have an end that broadens when viewed from the rear surface side of the liquid holding block 100 (tapered-off shape when viewed from the side of the recess section), in such a manner that treatment liquid can be recovered fully and evenly over the whole range of the breadthways direction of the recess section 102.

Furthermore, in the treatment liquid supply port 106, the edge portion 106*a* of the side wall on the treatment liquid recovery port side 108 in the outlet portion of the flow channel 106A is formed in a circular arc shape, and in the treatment liquid recovery port 108, the edge portion 108*a* of the side wall on the treatment liquid supply port side 106 in the outlet portion of the flow channel 108A is formed in a circular arc shape. In this way, by forming both the edge portion 106*a* on the output side of the treatment liquid supply port 106 and the edge portion 108*a* on the input side of the treatment liquid recovery port 108, which are disposed in parallel in upper and lower positions, to have a circular arc shape, it is possible to circulate and supply treatment liquid smoothly. In other words, it is possible to make the treatment liquid which has been supplied from the treatment liquid supply port 106 flow smoothly into the treatment liquid recovery port 108. In this way, it is possible to supply the treatment liquid in a stable fashion, without disturbing the flow of treatment liquid inside the treatment liquid holding space S. In particular, in the present example, the treatment liquid supply port 106 is disposed to the upstream side in terms of the direction of rotation of the application roller 34, and the treatment liquid flows following the direction of rotation of the application roller 34. Therefore, it is possible to circulate and supply the treatment liquid in a more stable state.

Moreover, the supply of treatment liquid to the application roller 34 is carried out by abutting the space forming block 100 against the outer circumferential surface of the application roller 34 and supplying treatment liquid to the treatment liquid holding space S formed by the abutting section. In other words, treatment liquid is circulated and supplied via the treatment liquid supply port 106 and the treatment liquid recovery port 108 to the treatment liquid holding space S, and by rotating the application roller 34 in this state, when the outer circumferential surface of the rotating application roller 34 passes the treatment liquid holding space S, it makes contact with the treatment liquid held in the treatment liquid holding space S and treatment liquid is thereby supplied to the outer circumferential surface of the application roller 34.

Furthermore, when the application roller 34 is rotated without being abutted against the paper 12, the treatment liquid which has been supplied to the application roller 34 is returned directly to the space forming block 100.

On the other hand, as described previously, the space forming block 100 is abutted against the outer circumferential surface of the application roller 34 and makes close contact with the outer circumferential surface of the application roller 34.

Consequently, if the treatment liquid is returned to the space forming block 100 directly without being applied to the paper 12, then it is wiped away by the upstream side portion 104A of the abutting section 104 of the space forming block 100 (the portion parallel to the axis of the application roller 34, which is the portion on the upstream side in terms of the direction of rotation of the application roller 34), and a collection of liquid is generated in this portion. Furthermore, in cases where treatment liquid remains on the application roller even if treatment liquid has been applied to the paper 12, when this liquid returns to the space forming block 100, it is also wiped away by the upper side portion 104A of the abutting section 104 of the space forming block 100, thus creating a collection of liquid in this portion. The collection of liquid created in this way eventually spills out from either end of the space forming block 100 and soils the apparatus.

Figure 4:
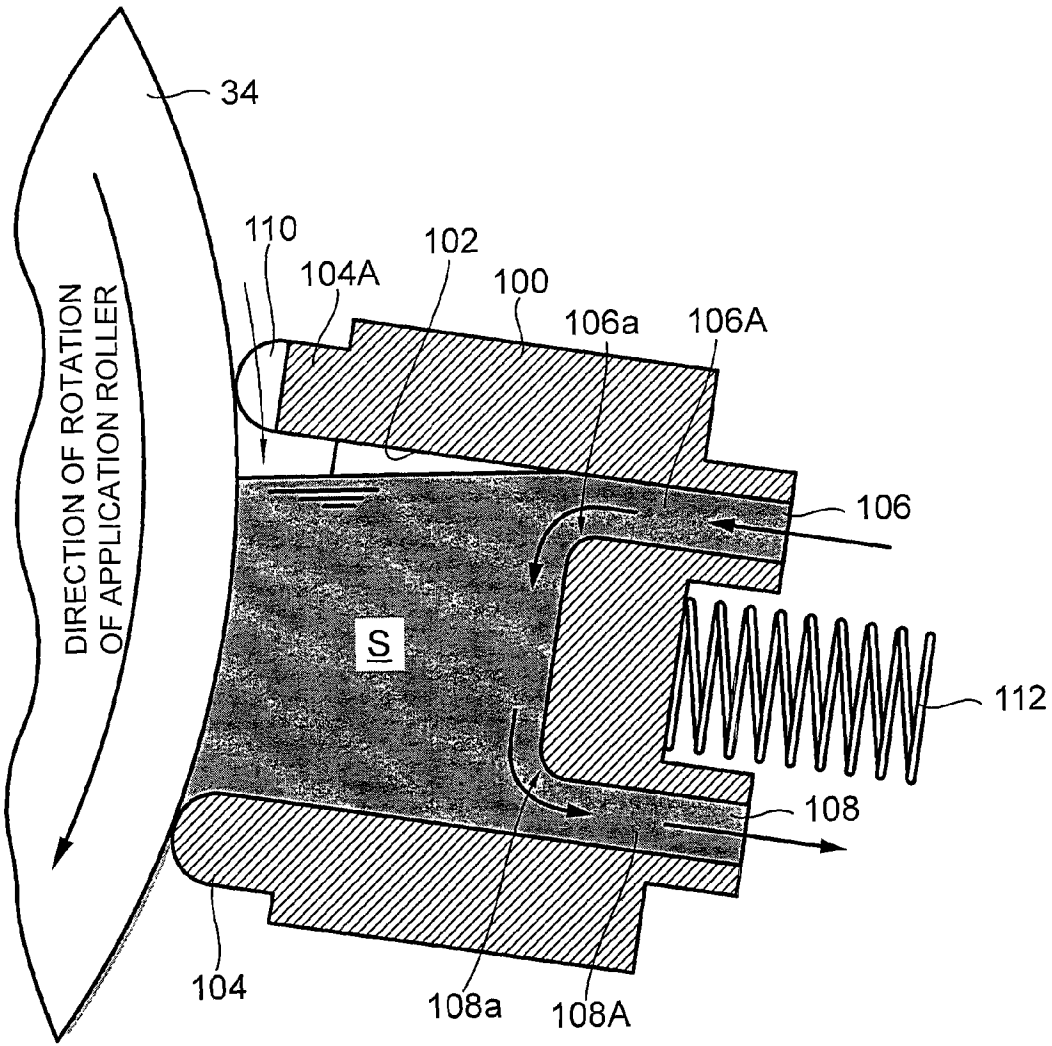
FIG. 4 is a cross-sectional side view diagram illustrating the composition of a space forming block.
Figure 5:
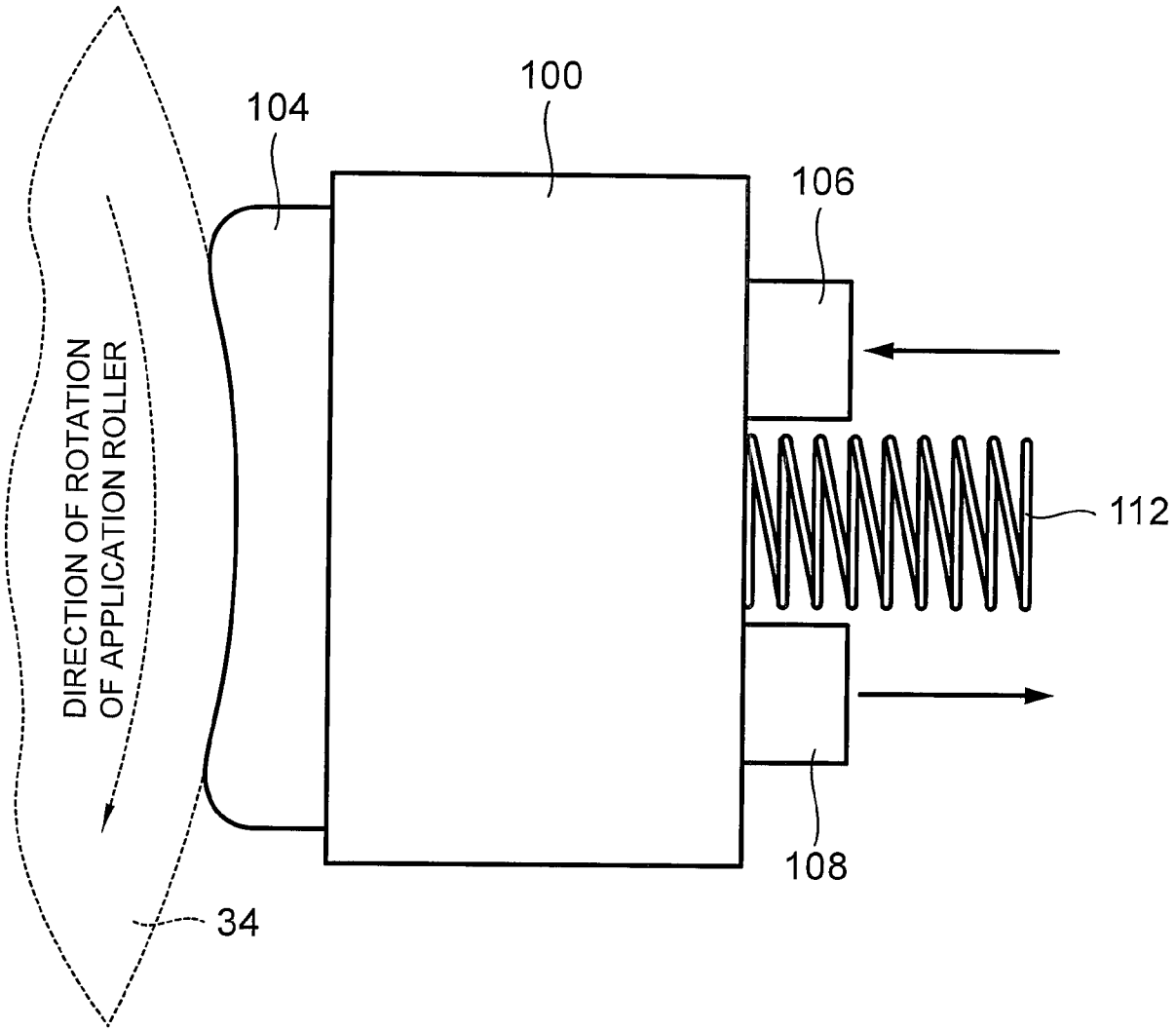
FIG. 5 is a side view diagram illustrating the composition of the space forming block.
Figure 6:
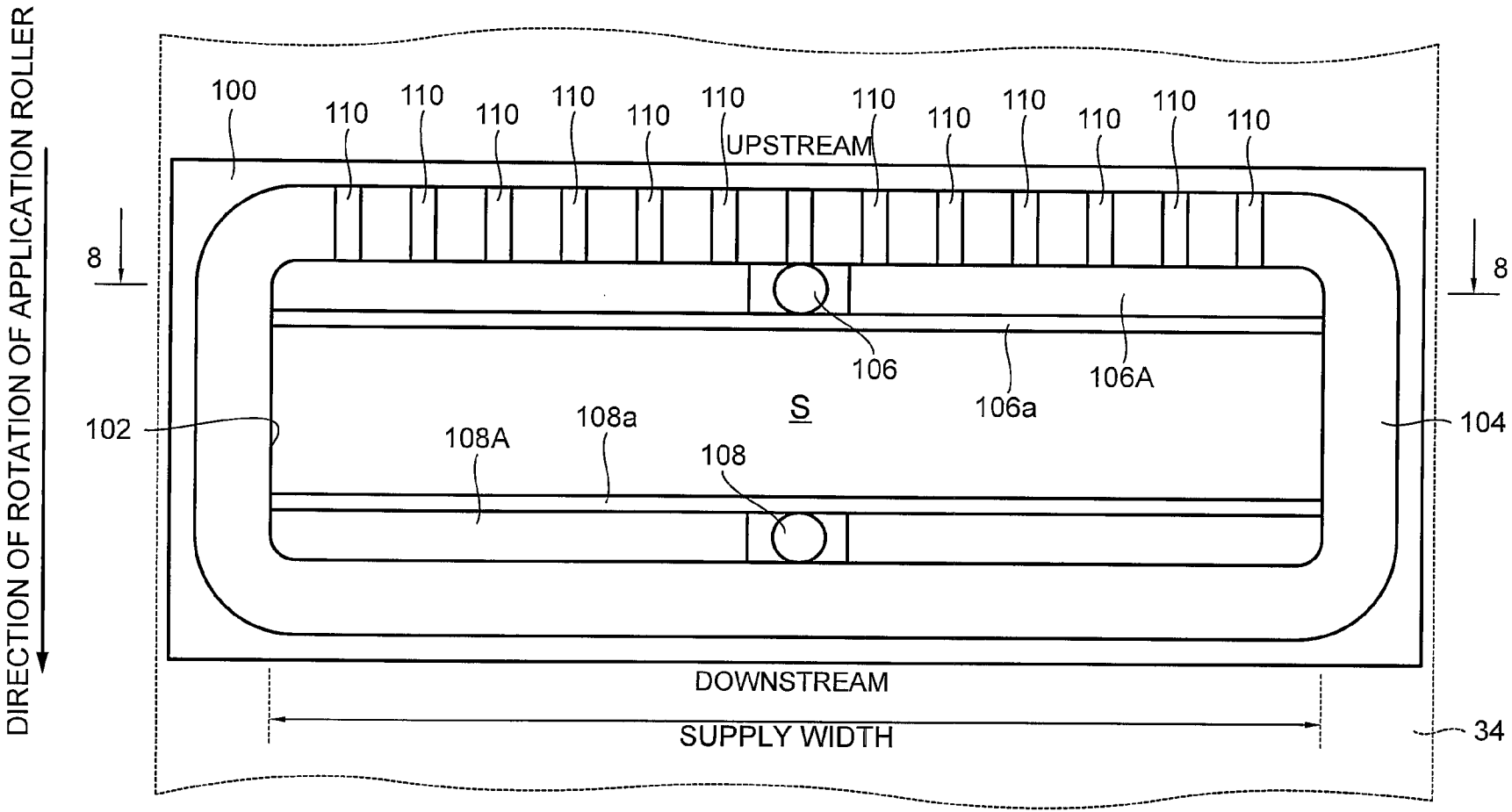
FIG. 6 is a front view diagram illustrating the composition of the space forming block.
Figure 7:
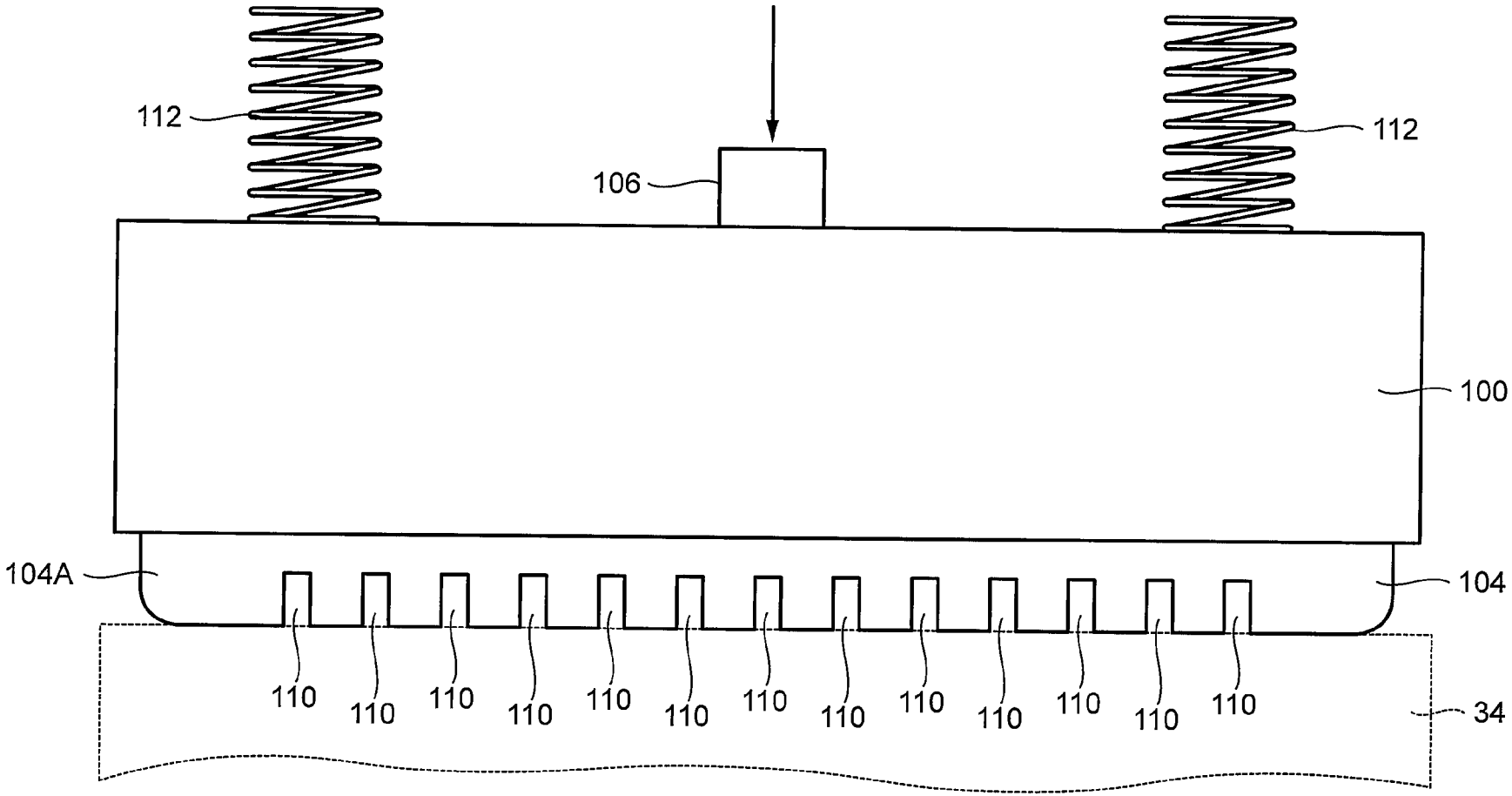
FIG. 7 is a plan view diagram illustrating the composition of the space forming block.

Therefore, in the space forming block 100 according to the present embodiment, as illustrated in FIGS. 4, 6 and 7, a plurality of grooves 110 are formed at a uniform pitch in the breadthways direction in the upstream side portion 104A of the abutting section 104. These grooves 110 are formed with a rectangular cross-section following the direction of rotation of the application roller 34.

The treatment liquid which is returned directly to the space forming block 100 without being applied to the paper 12 and the treatment liquid which is left on the application roller 34 after application is wiped away by the upper side portion 104A of the abutting section 104 of the space forming block 100 and is recovered via the grooves 110 into the treatment liquid holding space S. In this way, it is possible to prevent the creation of a collection of liquid in the upper side portion of the space forming block 100 and hence to avoid soiling of the apparatus.

The space forming block 100 has the composition described above.

The space forming block 100 is installed on the frame which supports the application roller 34, and is supported in an advanceable and retractable fashion with respect to the application roller 34. The space forming block 100 is impelled by a spring 112 interposed between itself and the frame and is thereby pressed against the outer circumferential surface of the application roller 34 with a prescribed pressing force.

Furthermore, in the present embodiment, as illustrated in FIG. 3, the space forming block 100 abuts against a diagonally downward right-hand position (approximately a "four o'clock" position) of the application roller 34 and forms a treatment liquid holding space S in this position.

The treatment liquid tank 120 is disposed at a prescribed position inside the main body of the apparatus and stores the treatment liquid which is supplied to the treatment liquid holding space S.

As illustrated in FIG. 3, a treatment liquid supply port 122 and a treatment liquid recovery port 124 are formed in the treatment liquid tank 120. The treatment liquid supply port 106 formed in the space forming block 100 is connected via a treatment liquid supply pipe 126 to the supply port 122 of the treatment liquid tank 120. Furthermore, the treatment liquid recovery port 108 formed in the space forming block 100 is connected via a treatment liquid recovery pipe 128 to the recovery port 124 of the treatment liquid tank 120.

The treatment liquid stored in the treatment liquid tank 120 is supplied to the treatment liquid supply port 106 of the space forming block 100 via the treatment liquid supply pipe 126 and is then supplied to the treatment liquid holding space S from this treatment liquid supply port 106. The treatment liquid supplied to the treatment liquid holding space S is recovered via the treatment liquid recovery port 108 of the space forming block 100 and is returned to the treatment liquid tank 120 via the treatment liquid recovery pipe 128. In other words, the treatment liquid is supplied in a circulating fashion.

The pump 130 is provided at an intermediate point of the treatment liquid supply pipe 126 and the treatment liquid is circulated and supplied by driving this pump 130. The system controller 62 described above controls the driving of the pump 130 and controls the circulation volume and the circulation pressure of liquid, via the treatment liquid application control unit 68. The thickness (film thickness) of the treatment liquid supplied to the application roller 34 is regulated by controlling this circulation volume and/or circulation pressure.

A valve 132 is provided in the treatment liquid recovery pipe 128, and by closing this valve 132, it is possible to hold treatment liquid inside the treatment liquid holding space S without circulating the liquid.

The action of the treatment liquid application apparatus 30 of the present embodiment which has the composition described above is as follows.

Firstly, the space forming block 100 is abutted against the outer circumferential surface of the application roller 34, thereby forming a treatment liquid holding space S on the outer circumferential surface of the application roller 34. As described above, the rear face of the space forming block 100 is impelled by a spring 112 and thereby pressed against the outer circumferential surface of the application roller 34. In the present example, the space forming block 100 is abutted against a diagonally downward right-hand position (approximately a "four o'clock" position) on the application roller 34, thereby forming a treatment liquid holding space S at this position.

Next, treatment liquid is supplied to the treatment liquid holding space S thus formed. Firstly, treatment liquid is supplied from the treatment liquid tank 120 to the space forming block 100 by closing the valve 132 and driving the pump 130 in this state. The treatment liquid supplied from the treatment liquid tank 120 is fed into the treatment liquid holding space S via the treatment liquid supply port 106 of the space forming block 100 and is stored in the treatment liquid holding space S.

In this case, in the space forming block 100 according to this embodiment, since the corner sections of the four edges and the lower surface of the recess section 102 which create the treatment liquid holding space S are formed in a circular arc shape, and since the outlet side edge portion 106*a* of the treatment liquid supply port 106 and the inlet side edge portion 108*a* of the treatment liquid recovery port 108 are formed in a circular arc shape, it is possible to supply the treatment liquid into the treatment liquid holding space S without creating any air bubbles.

When a prescribed time period has been exceeded from the start of the supply of liquid, then the supply of liquid by the pump 130 is halted. In this way, a prescribed amount of treatment liquid is stored inside the treatment liquid holding space S. The treatment liquid holding space S does not have to be filled completely with treatment liquid, and desirably the storage amount is such that some air remains inside the treatment liquid holding space S. Consequently, it is possible to recover the treatment liquid which has been returned to the space forming block 100, smoothly, from the grooves 110 and into the treatment liquid holding space S.

As described above, when treatment liquid has been stored inside the treatment liquid holding space S, then subsequently, the application roller 34 is driven so as to rotate and treatment liquid is thereby supplied to the application roller 34.

Firstly, the valve 132 is closed and the application roller 134 is driven to rotate at a prescribed speed of rotation with the pump 130 in a halted state. When the application roller 134 is driven to rotate in this way, treatment liquid is supplied to the surface of the application roller 134. In other words, by rotating the application roller 134, the outer circumferential surface of the roller passes the treatment liquid holding space S and during this passage the outer circumferential surface makes contact with the treatment liquid stored in the treatment liquid holding space S and the treatment liquid is deposited onto the outer circumferential surface.

During this initial rotation, the frame which supports the application roller 34 is disposed in a standby position, and the application roller 34 is separated from the back-up roller 32. Consequently, the treatment liquid supplied to the application roller 34 is returned directly to the space forming block 100.

The treatment liquid which has been returned to the space forming block 100 is partially wiped away from the surface of the application roller 34 by the upstream side portion 104A of the space forming block 100. The treatment liquid which has been wiped away is recovered into the treatment liquid holding space S via the grooves 110 formed in the portion 104A. Therefore, the treatment liquid does not collect in the upstream side portion 104A of the abutting section of the space forming block 100 and there is no leakage of treatment liquid from the space forming block 100. Consequently, even if treatment liquid is applied (in a state where the application roller 34 is separated from the back-up roller 32), it is still possible to rotate the application roller 34 while maintaining a clean state.

In this way, when a prescribed amount of treatment liquid has been stored in the treatment liquid holding space S, the treatment liquid is supplied to the application roller 34 by rotating the application roller 34. When the supply of treatment liquid has become stable (when the application roller 34 has performed a prescribed number of revolutions), the valve 132 is opened, the pump 130 is driven and the treatment liquid is circulated and supplied to the treatment liquid holding space S.

With the foregoing, the preparations for application are completed. Subsequently, application of treatment liquid to the paper 12 is carried out in association with the actual recording of images.

The application of the treatment liquid is carried out by advancing and withdrawing the application roller 34 with respect to the paper 12, in synchronism with the conveyance timing of the paper 12. In other words, since the paper 12 is conveyed by passing through a prescribed conveyance path 26, then the application of treatment liquid is performed by advancing and withdrawing the application roller 34 in synchronism with the passage of the paper 12 by the application section (the position where the application roller 34 which is moved with respect to the back-up roller 32 abuts against the back-up roller 32). More specifically, when the leading edge of the treatment liquid application region which is set previously on the paper 12 reaches the application section, the application roller 34 is abutted against the paper 12 and when the trailing edge of the treatment liquid application region reaches the application section, the application roller 34 is separated from the paper 12. In this way, treatment liquid is applied to the treatment liquid application region which is set previously on the paper 12.

This treatment liquid application region is set to a broader size than the image forming region, in order that the aggregating or insolubilizing action of the treatment liquid is performed reliably. The width of the treatment liquid application region is determined by the width of the treatment liquid supplied to the application roller 34 (supply width), and this supply width is determined by the width of the treatment liquid holding space S (the width of the abutting section 104).

In this way, the application of the treatment liquid is carried out by advancing and withdrawing the application roller 34 with respect to the paper 12, in synchronism with the conveyance timing of the paper 12.

By abutting the application roller 34 against the paper 12 in this way, the treatment liquid which has been supplied to the application roller 34 is transferred and deposited onto the paper 12, but the treatment liquid is not necessarily transferred completely and some treatment liquid may remain on the outer circumferential surface of the roller.

Nevertheless, even in cases where treatment liquid is left on the outer circumferential surface of the application roller 34 in this way, in the treatment liquid supply unit 36 according to the present embodiment, the residual treatment liquid which is returned to the space forming block 100 can be recovered into the treatment liquid holding space S via the grooves 110, and therefore no collection of treatment liquid occurs and the treatment liquid can be used in a clean state.

Furthermore, in the present embodiment, a flow following the direction of rotation of the application roller 34 is created inside the treatment liquid holding space S due to the circulation and supply of treatment liquid, and therefore the treatment liquid returning to the space forming block 100 is conveyed by this flow and can be recovered efficiently into the treatment liquid holding space S.

Due to the treatment liquid being applied to the paper 12, the treatment liquid is progressively removed from the treatment liquid holding space S, but as described above, since treatment liquid is circulated and supplied by the treatment liquid supply unit 36 of the present embodiment, then it is possible to fill a uniform amount of treatment liquid into the treatment liquid holding space S at all times. In this way, it is possible to supply treatment liquid in a stable fashion at all times onto the application roller 34.

Furthermore, since the treatment liquid supply unit 36 according to the present embodiment does not soil the apparatus even if the application roller 34 turns idly (namely, rotates without abutting against the paper 12), then it is possible to rotate the application roller 34 during standby (namely, when an application operation is not being carried out).

Consequently, it is possible to supply a treatment liquid in a stable state at all times onto the application roller 34. Furthermore, in this way, it is possible to apply the treatment liquid to the paper 12 in a stable fashion at all times, without the occurrence of application non-uniformities.

Moreover, by rotating the application roller 34 during standby as well in this way and thus supplying treatment liquid in a continuous fashion, then it is possible to prevent problems such as increased viscosity or separation (precipitation) of the treatment liquid, due to drying of the treatment liquid on the surface of the roller.

Moreover, by also rotating the application roller 34 during standby and supplying treatment liquid continuously in this way, then even if there is an interval between application operations, it is still possible to apply treatment liquid with suitable swiftness when the next application operation is carried out. In other words, in cases where the application roller 34 is not rotated during standby, then if an interval occurs between application operations, it is necessary to rotate the application roller 34 through a plurality of revolutions in order to stabilize the supply of treatment liquid to the application roller 34 during the next application operation, but since the treatment liquid supply unit 36 of the present embodiment rotates the application roller 34 during standby, it is possible to apply treatment liquid to the paper 12 in a stable fashion, even if the application roller 34 is abutted suddenly against the paper 12. Consequently, it is possible to shorten the overall processing time (print generation time).

In the present embodiment, the application roller 34 is rotated continuously during standby, but it is also possible to adopt a composition in which the roller is rotated in a non-continuous fashion (namely rotated with a uniform cycle or rotated in a random fashion), unless a problem of increased viscosity or separation of the treatment liquid, or the like, occurs on the application roller. Furthermore, it is also possible to adopt a composition in which the rotational speed of the application roller 34 is changed between an application operation and a standby operation (a standby state).

When the power supply to the inkjet recording apparatus 10 is switched off, the rotation of the application roller 34 is also halted, but it is also possible to cause the application roller 34 to rotate (in a wet state), even when the power supply to the inkjet recording apparatus 10 is switched off (processing liquid is circularly supplied when necessary). In this case, for example, a battery may be provided inside the main body of the apparatus and the application roller 34, and the like, is driven by power supplied from the battery. Furthermore, in this case, the application roller 34 does not necessarily have to rotate continuously, and it is also possible to adopt a composition in which the application roller 34 rotates in a non-continuous fashion unless there is a problem such as increased viscosity or separation of the treatment liquid, or the like, on the application roller.

It is also possible to rotate the application roller 34 in a similar fashion, even when application is not required, for instance, during a long standby period.

Furthermore, in the present embodiment, the treatment liquid is supplied in a circulating fashion, but it is also possible to adopt a composition which supplies treatment liquid to the treatment liquid holding space S in a suitable fashion, without circulating the treatment liquid. In this case, it is also possible to provide a sensor which determines the amount of treatment liquid stored in the recess section 102 in such a manner that treatment liquid is supplied to the treatment liquid holding space S in accordance with the output from the sensor.

If the treatment liquid is supplied by circulation, then it is also possible to provide a sensor which determines the storage volume of treatment liquid in the recess section 102 and to adjust the amount of treatment liquid circulated and supplied in accordance with the output from the sensor in such a manner that a uniform amount of treatment liquid is stored in the treatment liquid holding space S.

Furthermore, if the treatment liquid is supplied in a circulating fashion as in the present embodiment, then a composition which enables the circulation volume or circulation pressure of the treatment liquid to be controlled can be adopted, in such a manner that the thickness (film thickness) of the treatment liquid supplied to the application roller 34 can be adjusted by controlling the circulation volume or circulation pressure of the treatment liquid. Thereby, it is possible to adjust the thickness of the film applied in accordance with the type of paper 12, in such a manner that an image of high quality can be formed. For example, it is possible to apply treatment liquid in a suitable manner, on the basis of information relating to the permeability of treatment liquid into the recording medium, for instance, whether the medium is a permeable medium or non-permeable medium.

Figure 9:
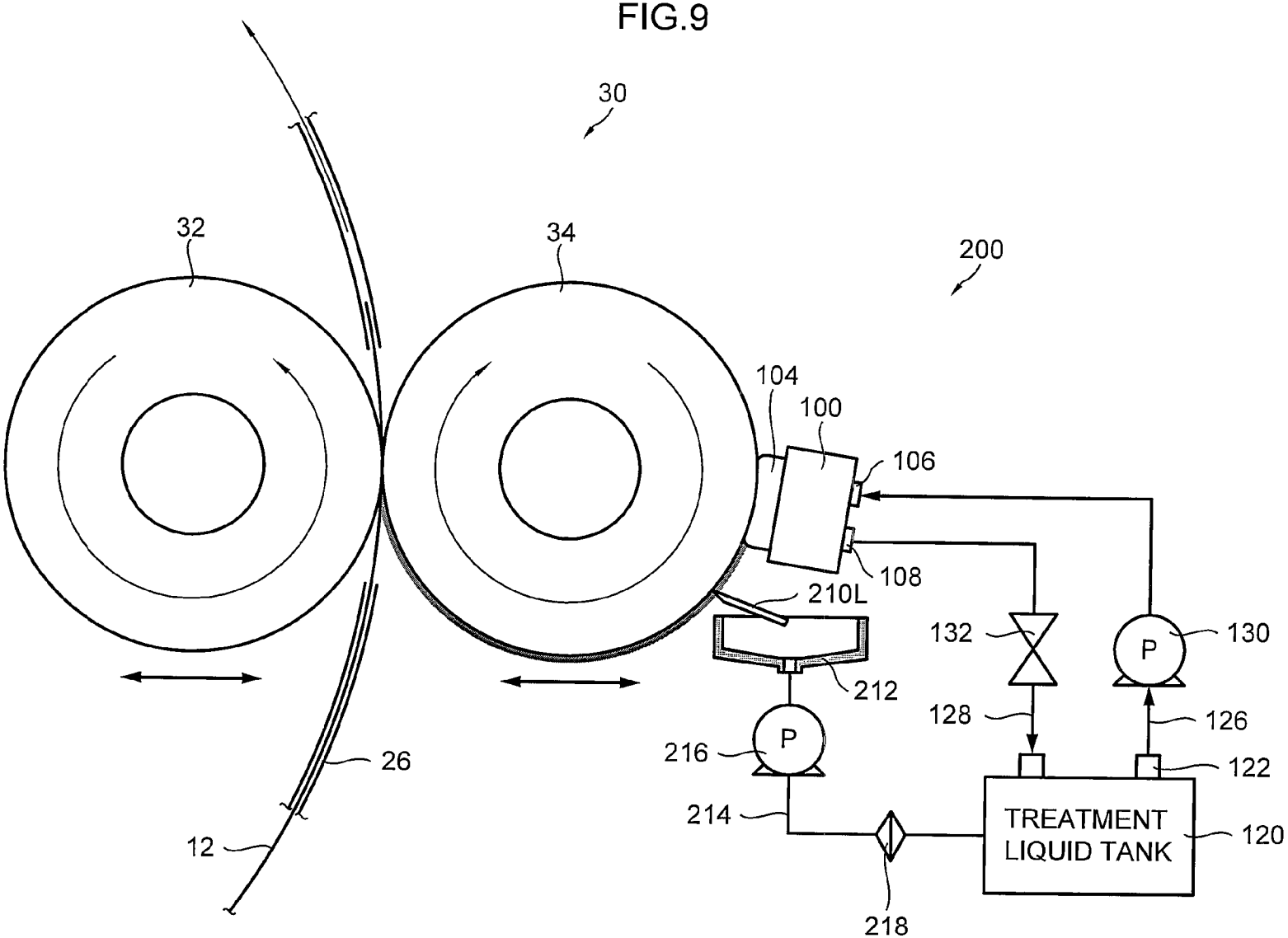
FIG. 9 is a side view diagram illustrating a composition according to one example of the treatment liquid application unit to which a second embodiment of the present invention is applied.

FIG. 9 is a side view diagram illustrating a composition according to a second embodiment of the treatment liquid application unit.

The treatment liquid application unit 200 according to the present embodiment changes the supply width of the treatment liquid which is supplied to the application roller 34 so as to be able to apply treatment liquid in an appropriate fashion in accordance with papers of various different widths.

Apart from the fact of comprising a supply width adjustment mechanism, the composition is the same as that of the treatment liquid application unit 30 in the inkjet recording apparatus 10 described above, and therefore only the composition of the supply width adjustment mechanism is described here.

As illustrated in FIG. 9, a pair of squeegees 210R and 210L are provided in the treatment liquid application unit 200 according to the present embodiment (in FIG. 9, only the left-hand-side squeegee 210L is depicted). This pair of squeegees 210R and 210L are disposed to the downstream side of the abutting section of the space forming block 100 with respect to the direction of rotation of the application roller 34 and are provided so as to abut against the respective end portions of the outer circumferential surface of the application roller 34.

The treatment liquid which has been supplied to the surface of the application roller 34 by means of the roller passing the treatment liquid holding space S is removed from a prescribed range in the respective end portions of the treatment liquid by passing between the pair of squeegees 210R and 210L, and hence the treatment liquid is adjusted to a prescribed supply width.

A recovery tray 212 is provided at a position below the pair of squeegees 210R and 210L, and the treatment liquid removed by the squeegees 210R and 210L is recovered in this recovery tray 212.

The treatment liquid recovered in the recovery tray 212 is returned to the treatment liquid tank 120 via the recovery pipe 214 and is then reused. A recovery pump 216 and a filter 218 are disposed in the recovery pipe 214, and the treatment liquid recovered into the recovery tray 212 is returned to the treatment liquid tank 120 by means of the recovery pump 216. When this treatment liquid is returned to the treatment liquid tank 120, dirt, dust, and the like, are removed from the liquid by passing through the filter 218.

The recovery tray 212 is installed on a frame (not illustrated) which supports the application roller 34, and moves together with the application roller 34.

Figure 10:
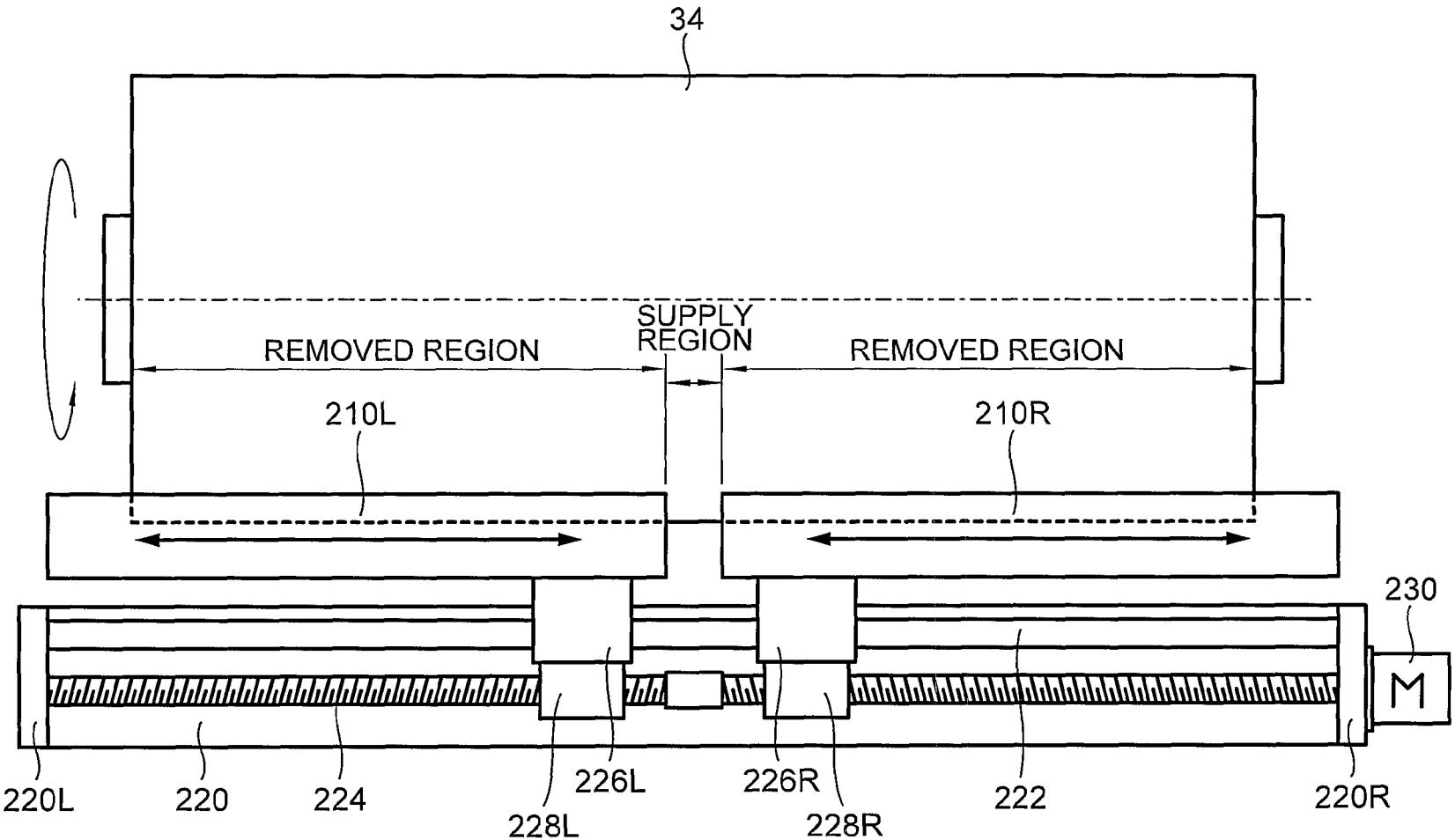
FIG. 10 is a plan diagram illustrating the composition of a squeegee driving unit.

FIG. 10 is a plan diagram illustrating the composition of a drive unit for the squeegees 210R and 210L.

As illustrated in FIG. 10, the squeegees 210R and 210L are each formed in a rectangular flat plate shape and are disposed in parallel with the axis of the application roller 34. The width of the squeegees (the length in the axial direction of the application roller 34) is set to be longer than half the width of the application roller 34. Consequently, when the respective edge sections of the squeegees are abutted against each other and aligned in position, their total length is greater than the width of the application roller 34 (see FIG. 11). When the respective edge sections have been abutted against each other, the treatment liquid which has been supplied to the application roller 34 is removed completely by the squeegees 210R and 210L.

Furthermore, these squeegees 210R and 210L are provided in lateral symmetry about the center of the application roller 34 in the axial direction of the roller, and the front edge sections of the squeegees respectively abut against the outer circumferential surface of the application roller 34.

As described above, the squeegees 210R and 210L are disposed to the downstream side of the space forming block 100 in terms of the direction of rotation of the application roller 34, and abut against the outer circumferential surface of the application roller 34 on the downstream side of the space forming block 100.

There are no particular restrictions on the abutting position of the squeegees, provided that it is on the downstream side of the space forming block 100 in terms of the direction of rotation of the application roller 34 and on the upstream side of the application unit. In other words, the squeegees should abut against the roller before the application unit. It is possible to adjust the width of the treatment liquid before the treatment liquid which has been supplied from the space forming block 100 is supplied to the application roller 34.

The squeegees 210R and 210L are respectively provided movably along the axial direction of the application roller 34, and the width of the treatment liquid supplied to the application roller 34 (the supply width) is changed by altering the positions of the squeegees 210R and 210L. The installation positions of the squeegees 210R and 210L are moved by means of the following mechanism.

As illustrated in FIG. 10, a base 220 is provided in parallel with the axis of the application roller 34 on a frame which supports the application roller 34 (not illustrated). A guide rod 222 and a screw rod 224 are provided on the base 220 in parallel with the axis of the application roller 34.

Both end portions of the guide rod 222 are affixed to brackets 220R and 220L which are provided on the base 220.

On the other hand, the screw rod 224 is provided in a rotatable fashion by means of the respective end portions of the rod being supported by bearings (not illustrated) which are provided on brackets 220R and 220L.

A pair of sliders 226R and 226L is provided slidably on the guide rod 222. The pair of squeegees 210R and 210L are provided on the sliders 226R and 226L, and are moved along the axis of the application roller 34 by moving these sliders 226R and 226L along the guide rod 222.

Furthermore, these sliders 226R and 226L are provided respectively with female screw sections 228R and 228L, and the screw rod 224 screws into these female screw sections 228R and 228L. Consequently, when the screw rod 224 is turned, the sliders 226R and 226L are moved by the action of the female screw sections 228R and 228L, and consequently the squeegees 210R and 210L move as well.

Here, the screw peaks formed on the screw rod 224 are formed in opposite directions toward the right and left-hand sides from the center in the axial direction, and therefore, when the screw rod 224 is turned, the sliders 226R and 226L move in mutually opposite directions. In other words, they move in mutually approaching directions or in mutually distancing directions, while maintaining lateral symmetry about the center of the axial direction of the application roller 34 at all times. Accordingly, the squeegees 210R and 210L also move in mutually approaching directions or in mutually distancing directions, while maintaining lateral symmetry about the center of the axial direction of the application roller 34 at all times.

The squeegee drive motor 230 provided on one bracket 220R is coupled to one end of the screw rod 224, and the screw rod 224 is rotated in the forward direction or reverse direction by driving the squeegee drive motor 230.

The drive unit of the squeegees 210R and 210L has the composition described above.

Next, the operations of supplying and applying treatment liquid by means of the treatment liquid application unit 200 according to the present embodiment will be described.

The operation of supplying the treatment liquid to the application roller 34 is the same as the treatment liquid application unit 30 of the embodiment described above. In other words, treatment liquid is circulated and supplied to the treatment liquid holding space S, and the application roller 34 is rotated. In this way, treatment liquid is supplied to the outer circumferential surface of the application roller 34 when it passes the treatment liquid holding space S.

The treatment liquid which is supplied to the outer circumferential surface of the application roller 34 when the application roller 34 passes the treatment liquid holding space S, passes between the pair of squeegees 210R and 210L after passing the treatment liquid holding space S, and hence a certain range at either end portion is removed by the pair of squeegees 210R and 210L. Consequently, the treatment liquid is adjusted to a certain width.

Since the squeegees 210R and 210L are disposed to the upstream side of the application unit, then the treatment liquid supplied to the application roller 34 is transferred and applied to the paper 12 at this adjusted width.

In this way, the treatment liquid application unit 200 according to the present embodiment is able to adjust the supply width of the treatment liquid to the application roller 34. Consequently, it is possible to apply treatment liquid in a suitable fashion in accordance with papers of various different widths.

The supply width of the treatment liquid is specified by the interval between the pair of squeegees 210R and 210L, and it is possible to adjust the supply width to any desired width by adjusting this interval.

This interval can be set to a value specified by the user, but if a device for automatically judging the type of paper is provided in the paper supply unit 20, then desirably, the interval is set automatically on the basis of the information received from this judgment device.

In the present embodiment, it is possible to adjust the interval between the pair of squeegees 210R and 210L in a stepless fashion (in a nonstep fashion), and therefore the liquid can be applied at a desired width.

Figure 11:
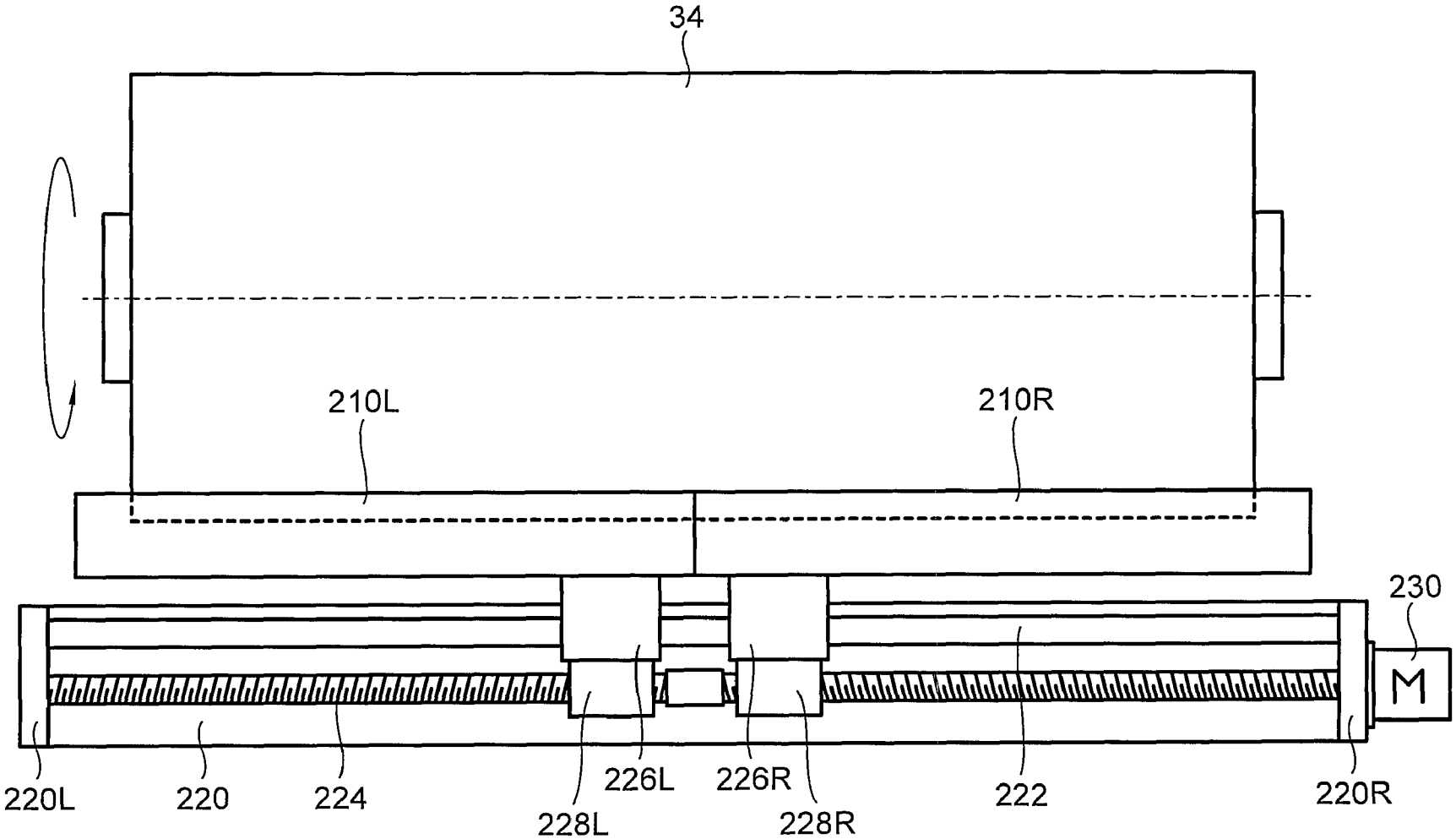
FIG. 11 is a plan diagram illustrating the composition of the squeegee driving unit.

Moreover, since the squeegees 210R and 210L according to the present embodiment are formed to be sufficiently long, then as illustrated in FIG. 11, it is possible to remove all of the treatment liquid which has been supplied to the application roller 34 by abutting the two squeegees together so as to unite the squeegees. By using this function, it is possible to clean the application roller 34.

Desirably, the cleaning of the application roller 34 by using the squeegees 210R and 210L is carried out when application of liquid is not required, for instance, when the power supply is off, or when the apparatus is at standby for a long period of time. For example, when application is not required, the squeegees 210R and 210L are united by being abutted against each other, and the application roller 34 is rotated by a prescribed amount in this state and the rotation of the application roller 34 is then halted. In this way, it is possible to make the application roller 34 wait at standby in a state where treatment liquid has been removed from its surface, and therefore it is possible to prevent solidification or adherence of treatment liquid on the surface of the application roller 34 during standby. It is also possible to rotate the application roller 34 during standby.

Figure 12:
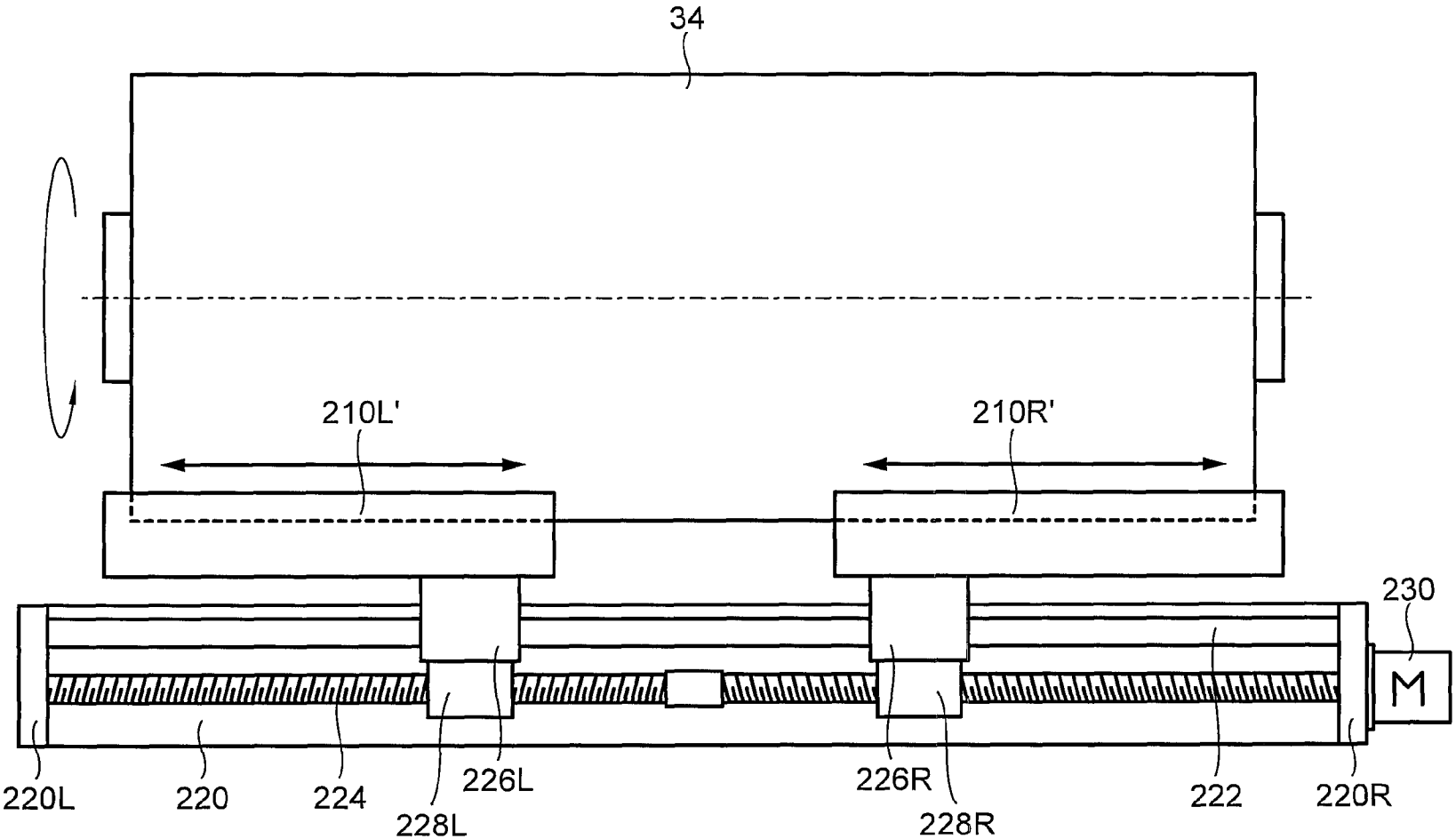
FIG. 12 is a plan diagram illustrating the composition of a further embodiment of the squeegee driving unit.

In the present embodiment, in order to achieve this cleaning function, the length of each of the squeegees 210R and 210L is set to be longer than half the width of the application roller 34, but as illustrated in FIG. 12, the length of the squeegees 210R' and 210L' can also be set shorter than half the width of the application roller 34.

Even if short squeegees 210R' and 210L' are used in this way, it is still possible to clean the application roller 34. More specifically, it is possible to clean substantially the whole area of the application roller 34 by rotating the application roller 34 while moving the squeegees 210R' and 210L' back and forth in the breadthways direction. In this case, the supply of treatment liquid is halted (the pump 130 is halted), the application roller 34 is rotated in a state where the space forming block 100 is separated by a prescribed amount (for example, approximately 2 mm) from the roller, and the squeegees 210R' and 210L' are moved back and forth in the breadthways direction.

In this way, it is possible to clean the application roller 34, even if using short squeegees 210R' and 210L'. Furthermore, by using short squeegees 210R' and 210L' in this way, it is possible to achieve a more compact size of the apparatus.

In the present embodiment, a composition is adopted in which a pair of squeegees are operated simultaneously using a single screw rod, but it is also possible to operate the respective squeegees independently. In this case, it is possible to adjust the width by moving one of the squeegees only, or to perform cleaning with only one of the squeegees only.

Figures 13A, 13B, 13C:
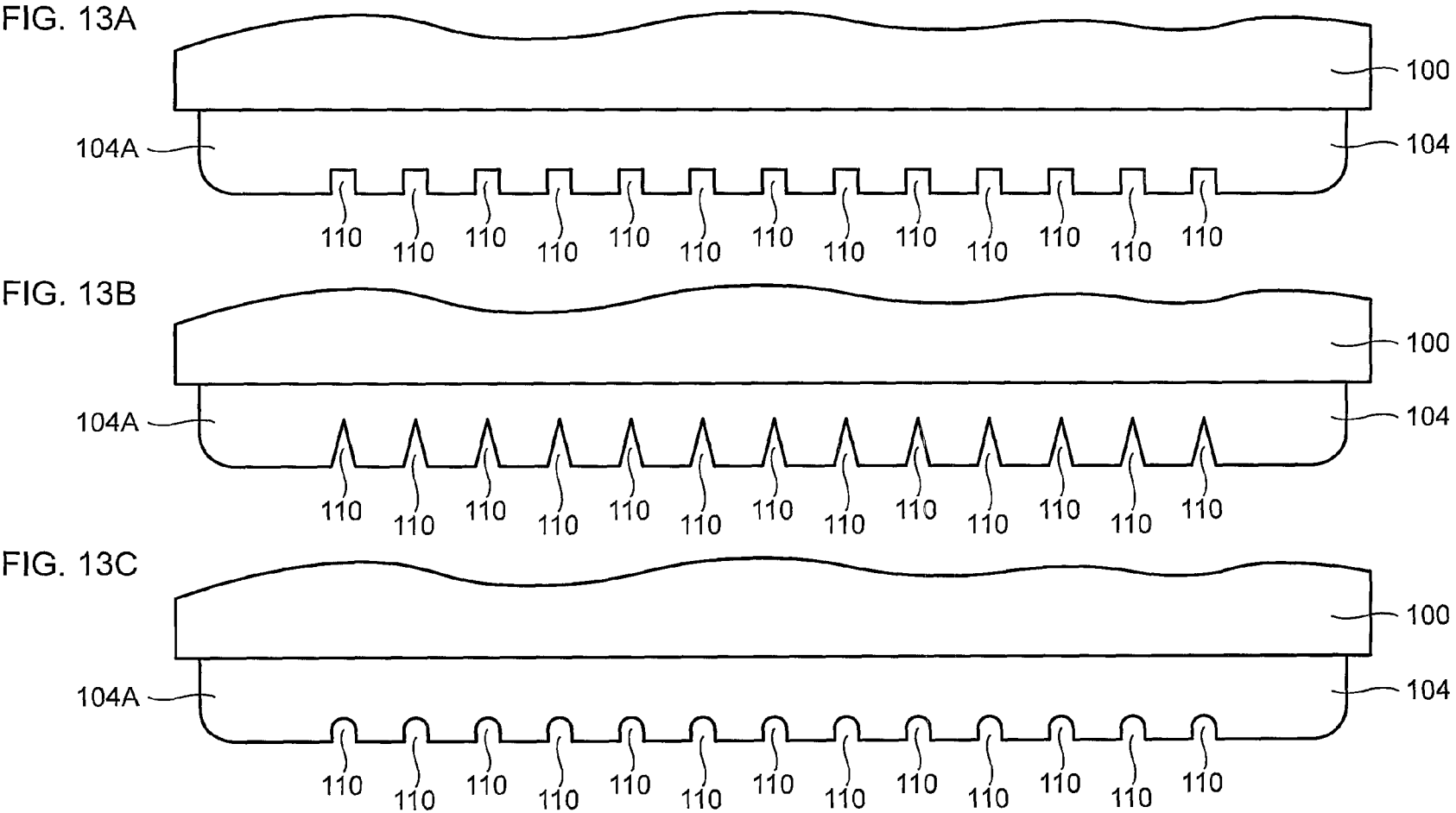
FIGS. 13A to 13C are plan diagrams illustrating the composition of further embodiments of the grooves.

Furthermore, in the present embodiment, the grooves 110 formed in the upstream side portion 104A of the abutting section 104 of the space forming block 100 are formed with a rectangular shape, but the shape of the grooves is not limited to this. Apart from this, as illustrated in FIGS. 13A to 13C, for example, it is also possible to form the grooves with a square cross-sectional shape (FIG. 13A), a triangular cross-sectional shape (FIG. 13B) or a semicircular cross-sectional shape (FIG. 13C).

Desirably, the width and height of the respective grooves 110 formed in this way are set in the range of 1 mm to 5 mm. If the width or height of the grooves is equal to or less than 1 mm, then if blocking of the grooves occurs due to drying and separation of the treatment liquid, the recovery operation takes a long time, whereas if the width of the grooves is equal to or greater than 5 mm, then various problems occur, for instance, infiltration of foreign matter cannot be prevented, the effect in preventing the drying of the treatment liquid stored in the treatment liquid holding space S is lowered, and leakage of liquid occurs when the application roller 34 is withdrawn.

Furthermore, desirably, the interval of the mutually adjacent grooves is set appropriately in the range of 10 mm to 50 mm.

Moreover, in the present embodiment, an example is described in which a prescribed treatment liquid is applied to paper in an inkjet recording apparatus, but there are no particular restrictions on the application of the present invention. The present invention can be applied in general to application apparatuses which apply a liquid to a medium using an application roller.

Moreover, in the embodiments described above, an example is given in which treatment liquid is applied to paper, but the object (medium) onto which the treatment liquid is applied is not limited in particular to this. Various media can be used as the object medium, such as normal paper, a recording medium having an ink receiving layer, or a recording sheet which is permeable to air in the thickness direction, such as processed paper, or a flexible medium which is not permeable to air, such as an OHP sheet.

Furthermore, in the embodiments described above, an example is given in which the present invention is applied to an inkjet recording apparatus which forms an image only on one surface of paper, but the present invention may also be applied in a similar fashion to an inkjet recording apparatus which forms images on both surfaces of paper.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An application liquid supply apparatus for supplying an application liquid to an application roller which abuts against a medium while rotating so as to apply the application liquid to the medium, the application liquid supply apparatus comprising:

a space forming enclosure configured to abut against an outer circumferential surface of the application roller, the space forming enclosure including a recess section and a frame-shaped abutting section, the recess section constituting a perimeter structure of the space forming enclosure and being formed along a breadthways direction of the application roller, the frame-shaped abutting section extending the perimeter structure and configured to abut against the outer circumferential surface of the application roller so that, when placed against the outer circumferential surface of the application roller, an opening of the recess section is covered with the outer circumferential surface of the application roller in such a manner that an application liquid holding space is created along the breadthways direction on the outer circumferential surface of the application roller;

at least one groove which has a length in a direction of rotation of the application roller and is formed at a roller-abutting surface of the abutting section on an upstream side in terms of the direction of the rotation of the application roller, the groove configured to permit excess application liquid from the application roller to re-enter the application liquid holding space;

an application liquid supply port which is formed in the space forming enclosure and configured to supply application liquid to the application liquid holding space; and an application liquid supply device configured to supply the application liquid to the application liquid holding space via the application liquid supply port.

2. The application liquid supply apparatus as defined in claim 1, comprising a pair of squeegees which is provided to a downstream side of the space forming enclosure in terms of the direction of the rotation of the application roller, and which wipes away both end portions of the application liquid that has been supplied to the application roller in such a manner that the application liquid supplied to the outer circumferential surface of the application roller becomes a certain width.

3. The application liquid supply apparatus as defined in claim 2, wherein the squeegees are provided movably in the breadthways direction of the application roller.

4. The application liquid supply apparatus as defined in claim 1, wherein:

an application liquid recovery port which recovers the application liquid that has been supplied into the application liquid holding space is provided in the space forming enclosure; and the application liquid supply device supplies the application liquid to the application liquid holding space in a circular manner via the application liquid supply port and the application liquid recovery port.

5. The application liquid supply apparatus as defined in claim 4, wherein the application liquid supply port is provided to an upstream side of the application liquid recovery port in terms of the direction of the rotation of the application roller.

6. The application liquid supply apparatus as defined in claim 4, wherein the application liquid supply device is able to adjust a circulation volume of the application liquid which is supplied to the application liquid holding space in the circular manner.

7. The application liquid supply apparatus as defined in claim 4, wherein the application liquid supply device is able to adjust a circulation pressure of the application liquid which is supplied to the application liquid holding space in the circular manner.

8. An inkjet recording apparatus ejecting an ink onto a medium, the inkjet recording apparatus comprising the application liquid supply apparatus as defined in claim 1, wherein:

the application liquid has a function of reacting with the ink so as to aggregate or insolubilize a coloring material contained in the ink;

the application liquid supply apparatus supplies the application liquid to the application roller;

the application roller applies the application liquid to the medium; and the ink is ejected onto the medium on which the application liquid has been applied in such a manner that an image is formed on the medium.

9. The application liquid supply apparatus as defined in claim 1, wherein the abutting section has a front end having a circular arc-shaped cross-section.

10. The application liquid supply apparatus as defined in claim 9, wherein the abutting section is formed in an integrated fashion with the space forming enclosure.

* * * * *